US009828132B2

(12) United States Patent
Jones et al.

(10) Patent No.: US 9,828,132 B2
(45) Date of Patent: Nov. 28, 2017

(54) BLANK, SLEEVE AND PACKAGING SYSTEM

(71) Applicant: MeadWestvaco Corporation, Richmond, VA (US)

(72) Inventors: Steven P. Jones, Elon, NC (US); Joe Billy Oakes, Prospect Hill, NC (US)

(73) Assignee: WestRock MWV, LLC, Norcross, GA (US)

( * ) Notice: Subject to any disclaimer, the term of this patent is extended or adjusted under 35 U.S.C. 154(b) by 110 days.

(21) Appl. No.: 14/345,469

(22) PCT Filed: Sep. 27, 2012

(86) PCT No.: PCT/US2012/057453
§ 371 (c)(1),
(2) Date: Mar. 18, 2014

(87) PCT Pub. No.: WO2013/049282
PCT Pub. Date: Apr. 4, 2013

(65) Prior Publication Data

US 2014/0346219 A1 Nov. 27, 2014

Related U.S. Application Data

(60) Provisional application No. 61/540,186, filed on Sep. 28, 2011, provisional application No. 61/604,553, filed on Feb. 29, 2012.

(51) Int. Cl.
*B65D 5/54* (2006.01)
*B65D 5/64* (2006.01)
(Continued)

(52) U.S. Cl.
CPC ..... *B65D 5/5405* (2013.01); *B65D 5/0227* (2013.01); *B65D 5/4208* (2013.01);
(Continued)

(58) Field of Classification Search
CPC ..... B65D 5/5405; B65D 5/643
(Continued)

(56) References Cited

U.S. PATENT DOCUMENTS 2,811,297 A * 10/1957 Maxon ..... B65D 5/742 229/212
3,549,082 A * 12/1970 Simpson ..... B65D 5/541 229/209
(Continued)

FOREIGN PATENT DOCUMENTS

CN 1882476 A 12/2006
CN 1902098 A 1/2007
(Continued)

OTHER PUBLICATIONS

International Search Report and Written Opinion for PCT/US2012/057453, dated Mar. 23, 2103.

*Primary Examiner* — Christopher Demeree
(74) *Attorney, Agent, or Firm* — WestRock Intellectual Property Group

(57) ABSTRACT

A package made from sheet material made from a plurality of panels, including a first panel on an external face of the package and adhesively attached to another panel. A corner on an outside surface of the first panel is provided with a nearby perforation or line of weakness to discourage peeling of the corner.

11 Claims, 32 Drawing Sheets

(51) Int. Cl.
*B65D 5/02* (2006.01)
*B65D 5/42* (2006.01)
*B65D 83/04* (2006.01)

(52) U.S. Cl.
CPC ..... *B65D 5/4225* (2013.01); *B65D 5/643* (2013.01); *B65D 83/0463* (2013.01)

(58) Field of Classification Search
USPC ..... 229/131.1, 134, 102, 136, 150, 124; 206/807
See application file for complete search history.

(56) References Cited

U.S. PATENT DOCUMENTS

| | | | | |
|---|---|---|---|---|
| 8,066,178 | B2 * | 11/2011 | Sorrentino ..... | B65D 5/0227 206/769 |
| 2005/0145683 | A1 * | 7/2005 | Alagna ..... | B65D 5/541 229/102 |
| 2010/0170941 | A1 * | 7/2010 | Mitra-Shah ..... | B65D 5/4204 229/102 |

FOREIGN PATENT DOCUMENTS

| | | | |
|---|---|---|---|
| CN | 101808909 | A | 8/2010 |
| WO | WO03078275 | A1 | 9/2003 |
| WO | WO2005000692 | A1 | 1/2005 |
| WO | WO2005054067 | A1 | 6/2005 |

* cited by examiner

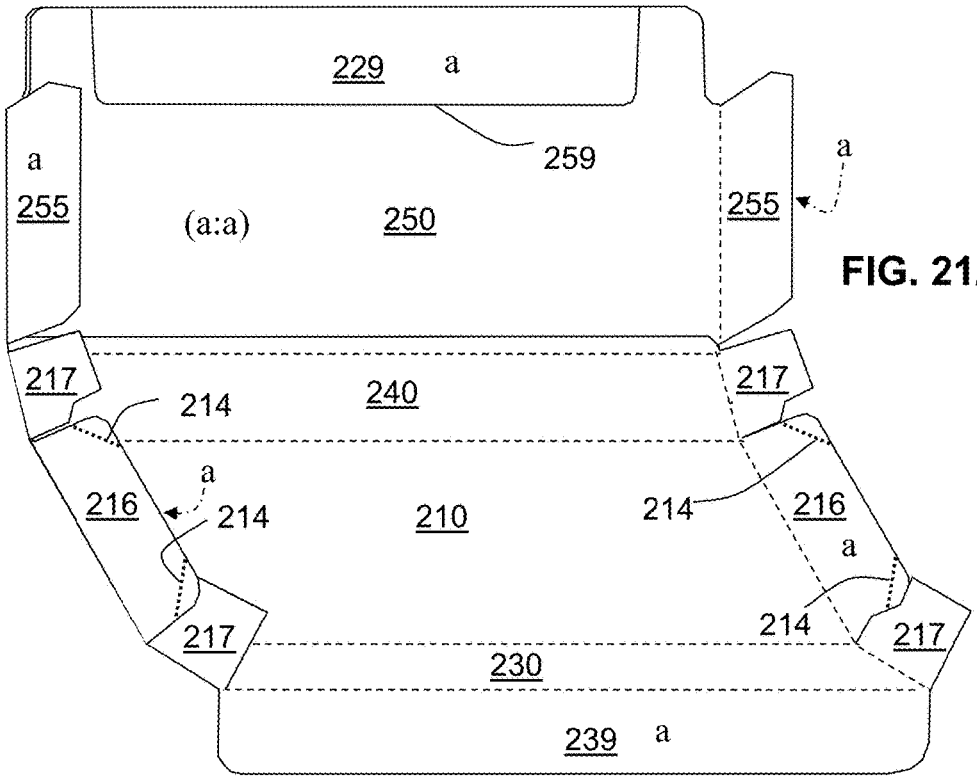
FIG. 21A
FIG. 21B
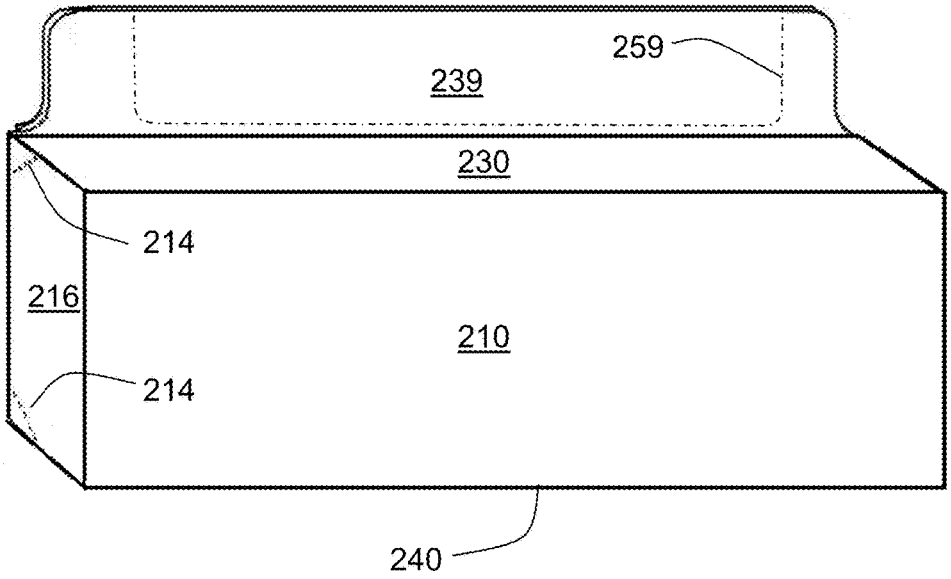

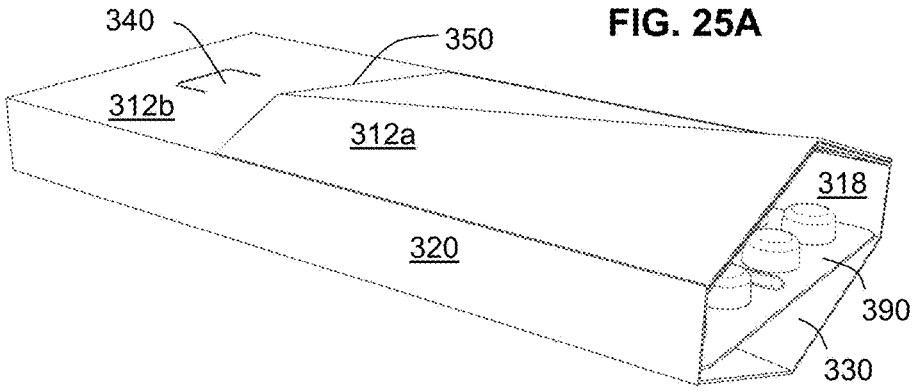
FIG. 25A
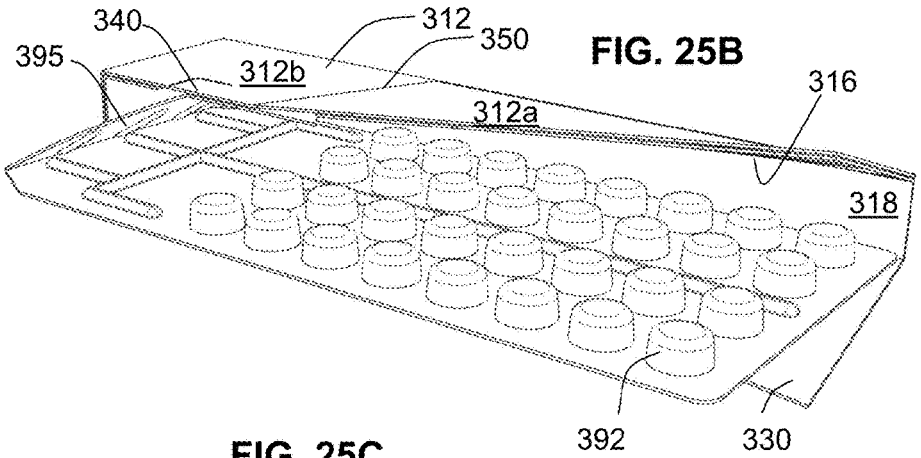
FIG. 25B
FIG. 25C
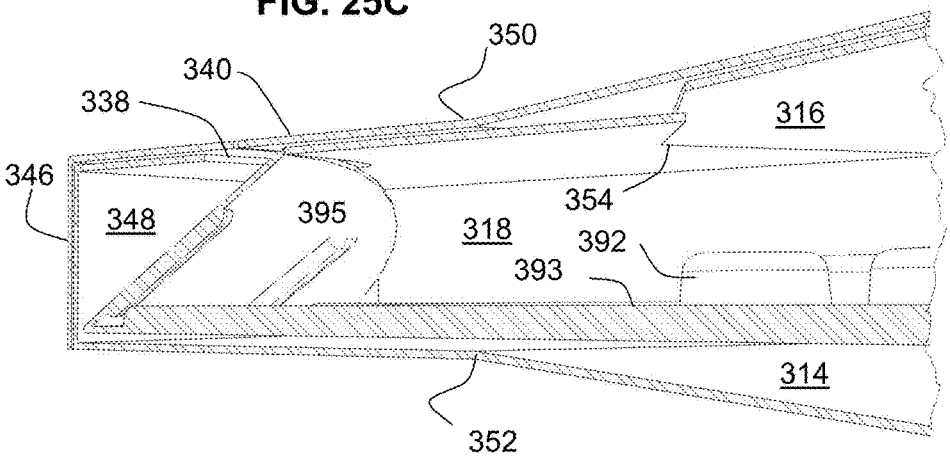

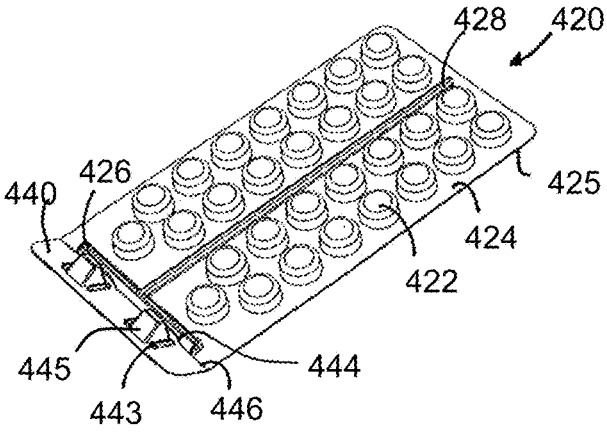
FIG. 26A
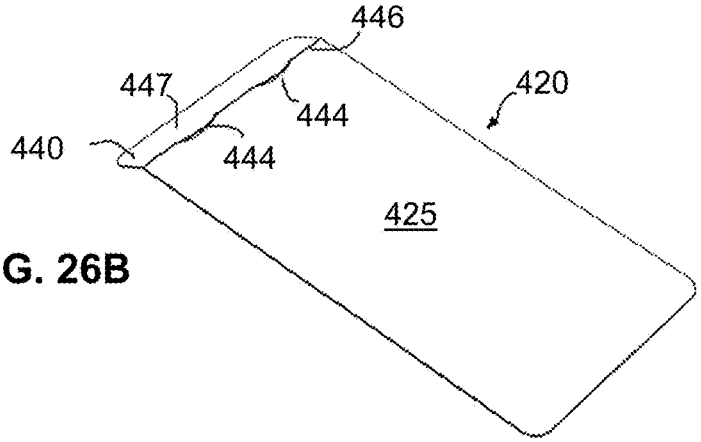
FIG. 26B
FIG. 26C
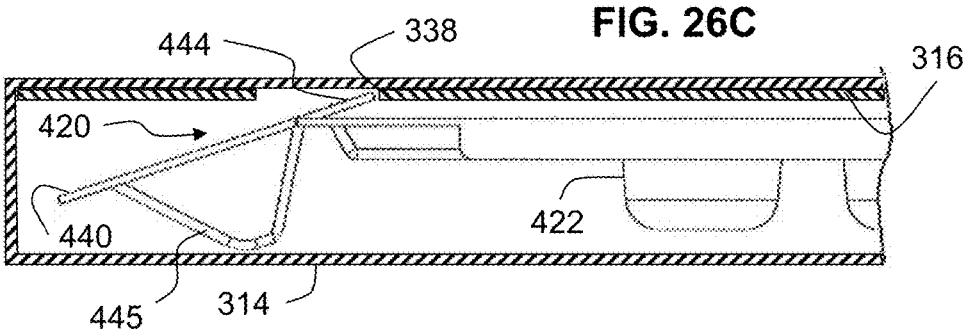

BLANK, SLEEVE AND PACKAGING SYSTEM

REFERENCE TO RELATED APPLICATIONS

This application is a National Stage entry into the United States of International Application PCT/US2012/057453 filed on Sep. 27, 2012, which claims the benefit of priority under 35 U.S.C. §119(e) of U.S. provisional application Ser. No. 61/540,186 filed on Sep. 28, 2011, and Ser. No. 61/604,553 filed on Feb. 29, 2012, all of which are hereby incorporated by reference in their entireties.

BACKGROUND

The present application is directed to paperboard packages and, more particularly, to improved flap sealing for paperboard packages.

The present invention also relates to a blank for forming an outer sleeve, an outer sleeve and a packaging system, more specifically, but not exclusively to a lockable packaging system optionally for use as child-proof packaging. Further specifically, but not exclusively, the invention relates to a mechanism for and a method of mitigating against bowing of panels and accidental or unintentional unlocking of an inner slide card from an outer sleeve. Further specifically, but not exclusively, the invention relates to a mechanism for and a method of mitigating against peeling the corners of closure flaps which may be attempted in an effort to break into the package.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK packages. Packaging made primarily of paperboard is more sustainable than packaging made from petroleum-based plastics. The paperboard used in such packages may be tear-resistant. One of the surfaces of the paperboard, for example the inner or unprinted surface, which may also be a tear-resistant surface, may include a heat-seal coating. Such heat seal coatings are most advantageously used by sealing a surface with the heat seal coating to another surface with the heat seal coating. It is sometimes difficult to design the package to most effectively incorporate the heat sealing.

Accordingly, there is a need for a package with improved sealing of the various panels, in particular, the end flaps of the package.

Also in the field of packaging, particularly in the field of healthcare and medication packaging, it is often required to provide consumers or patients with secure packaging that has child-resistant features to restrict or prevent access to the package contents by a child. Many packages are available that comprise an inner slide card that directly or indirectly holds articles such as medicaments, tablets or vitamins optionally in sealed blister cavities. The inner slide card, with the blisters of articles, is slidable inside an outer sleeve and is usually retained and locked inside the outer sleeve, optionally by a tail locking flap of the inner slide card engaging an aperture on the outer sleeve. An unlocking mechanism is usually provided on the outer sleeve to permit the release of the inner slide card (optionally by disengaging the locking flap of the inner slide card from the locking aperture of the outer sleeve). Such unlocking mechanisms often require some dexterity to operate or require user realization that coordinated operation of more than one feature is required; this may make the package child-resistant.

However, known packages can suffer from a failure of the locking mechanism if a user squeezes the sides of the outer sleeve toward one another causing the top and bottom walls of the outer sleeve to bow. This bowing action is sometimes referred to as "pillowing". In some known packages, as a result of the outer sleeve pillowing, the locking mechanism is accidentally or inadvertently disengaged.

The present invention also seeks to provide an improvement in the field of packaging, more specifically, but not exclusively, in the field of packages comprising inner slide-cards and outer-sleeves by providing a blank for forming an outer sleeve, an outer sleeve and a package system comprising a mechanism to prevent or mitigate against accidental disengagement of the locking mechanism as a result of pillowing. The mechanism to prevent or mitigate against the effects of bowing or pillowing and a method of forming the mechanism may have advantageous application outside of application to outer sleeve and inner slide card packages, as such aspects of the invention relate to the mechanism and method separately.

SUMMARY

In one aspect, a packaging structure is disclosed which comprises a plurality of panels and at least a first closure flap. The first closure flap includes a flap extension, and either the closure flap or its flap extension includes a cutout area. When the package is closed, the cutout area aligns with at least part of a second closure flap or flap extension, or with at least part of one of the plurality of panels.

In another aspect the cutout area in the first closure flap or its flap extension aligns with an embossed area in the other of the first closure flap or its flap extension.

In another aspect the cutout area in the first closure flap or its flap extension aligns with an embossed area in a second closure flap or closure flap extension, or in one of the plurality of panels.

Other aspects of the invention provide a blank, an outer sleeve, a mechanism, a method and a package system as claimed in the appended claims.

According to an aspect of the present invention there is provided a mechanism for mitigating against bowing apart or pillowing of first and second spaced and interconnected panels of a package formed from sheet material, which first and second spaced panels are spaced and interconnected by further panels, the mechanism comprising:

a line of separation formed in the first panel and arranged such that two regions of the first panel are formed: a first region disposed substantially on one side of the line of separation; and a second region disposed substantially on the other side of the line of separation; the line of separation terminating within the first region and being directed towards the second region; and a line of demarcation formed in the second panel and arranged such that two regions of the second panel are formed: a first region disposed substantially on one side of the line of demarcation; and a second region disposed substantially on the other side of the line of demarcation; the line of demarcation being directed towards the first region;

whereby, upon a compressive force being applied to said further panels, the first and second panels may bow outwardly away from one another only in the second region and the line of separation and line of demarcation together prevent or mitigate against the first and second panels from bowing outwardly away from one another in the first region.

Optionally, an outer shell for a packaging system may comprise the mechanism of the preceding paragraph. Further optionally, said first panel may be an inner top panel of the outer shell and said second panel may be a bottom panel of the outer shell and the outer shell may further comprise an outer top panel, overlaid said inner top panel and the outer top panel may further comprise a line of demarcation arranged such that two regions of the outer top panel are formed: a first region disposed substantially on one side of the line of demarcation; and a second region disposed substantially on the other side of the line of demarcation; said line of demarcation being directed towards the first region.

According to another aspect of the invention, there is provided a method of mitigating against bowing apart or pillowing of first and second spaced panels of a package formed from sheet material, which first and second spaced panels are spaced and interconnected by further panels, the method comprising:

providing, in the first panel, a line of separation arranged such that two regions of the first panel are formed: a first region disposed substantially on one side of the line of separation; and a second region disposed substantially on the other side of the line of separation; the line of separation terminating within the first region and being directed towards the second region;

providing, in the second panel, a line of demarcation arranged such that two regions of the second panel are formed: a first region disposed substantially on one side of the line of demarcation; and a second region disposed substantially on the other side of the line of demarcation; the line of demarcation being directed towards the first region;

whereby, upon a compressive force being applied to said further panels, the first and second panels may bow outwardly away from one another only in the second region and the line of separation and line of demarcation together prevent or mitigate against the first and second panels from bowing outwardly away from one another in the first region.

According to another aspect of the present invention there is provided an outer shell for a packaging system comprising: an inner top panel, an outer top panel, a bottom panel, first and second side panels interconnecting and spacing said inner and outer top panels from the bottom panel, an inner slide card engaging edge and an unlocking mechanism, the outer shell further comprising a mechanism for mitigating against bowing apart or pillowing of the bottom panel and the inner and outer top panels, wherein said mechanism comprises a line of separation formed in the inner top panel sized and configured for maintaining a region of the inner top panel proximate the engaging edge in a substantially flat form. Optionally, the inner slide card engaging edge is provided by an aperture formed in the inner top panel.

Optionally, the inner top panel may comprise a line of separation having a substantially "V"-shape directed toward an open front end of the outer shell and directed away from an engaging edge formed at least in part by the inner top panel.

Optionally, the bottom panel and/or outer top panel may comprise a line of demarcation having a substantially inverted "V"-shape directed away from an open front end of the outer shell and directed toward an engaging edge formed at least in part by the inner top panel.

Preferably, the line of separation terminates within the inner top panel and terminates in acute arcs.

Optionally, the lines of demarcation are substantially superimposed over one another in vertical alignment.

Optionally, the line of separation is vertically aligned with the lines of demarcation at two points on the line of separation.

Optionally a crease line may extend from each termination of the line of separation and may terminate on an adjacent edge of the inner top panel.

Optionally, one or more or an aligned series of stiffening ribs may be provided in the inner top panel proximate the engaging edge.

Optionally, an unlocking tab may be arranged and configured such that a cut free edge of the unlocking tab is closer to a rear end of the outer shell than the hinging end of the unlocking tab.

Optionally, the lines of demarcation and the line of separation are each similarly angled or are each differently angled or two of them are similarly angled and one of them is differently angled.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

Other aspects of the disclosed packaging structures will become apparent from the following description and the accompanying drawings.

BRIEF DESCRIPTION OF THE DRAWINGS

Exemplary embodiments of the invention will now be described with reference to the accompanying drawings, in which:

FIGS. 21A-21B are perspective views of the package of FIG. 20 being assembled and after assembly, showing certain security features;

FIGS. 25A-25C are perspective views similar to FIG. 24 in an intact and cutaway view, and detail view, respectively;

FIGS. 26A-26B are perspective views of blister cards;

FIG. 26C is a cross section detail of a locking mechanism for the blister cards of FIGS. 26A-26B;

DETAILED DESCRIPTION

Figure 1:
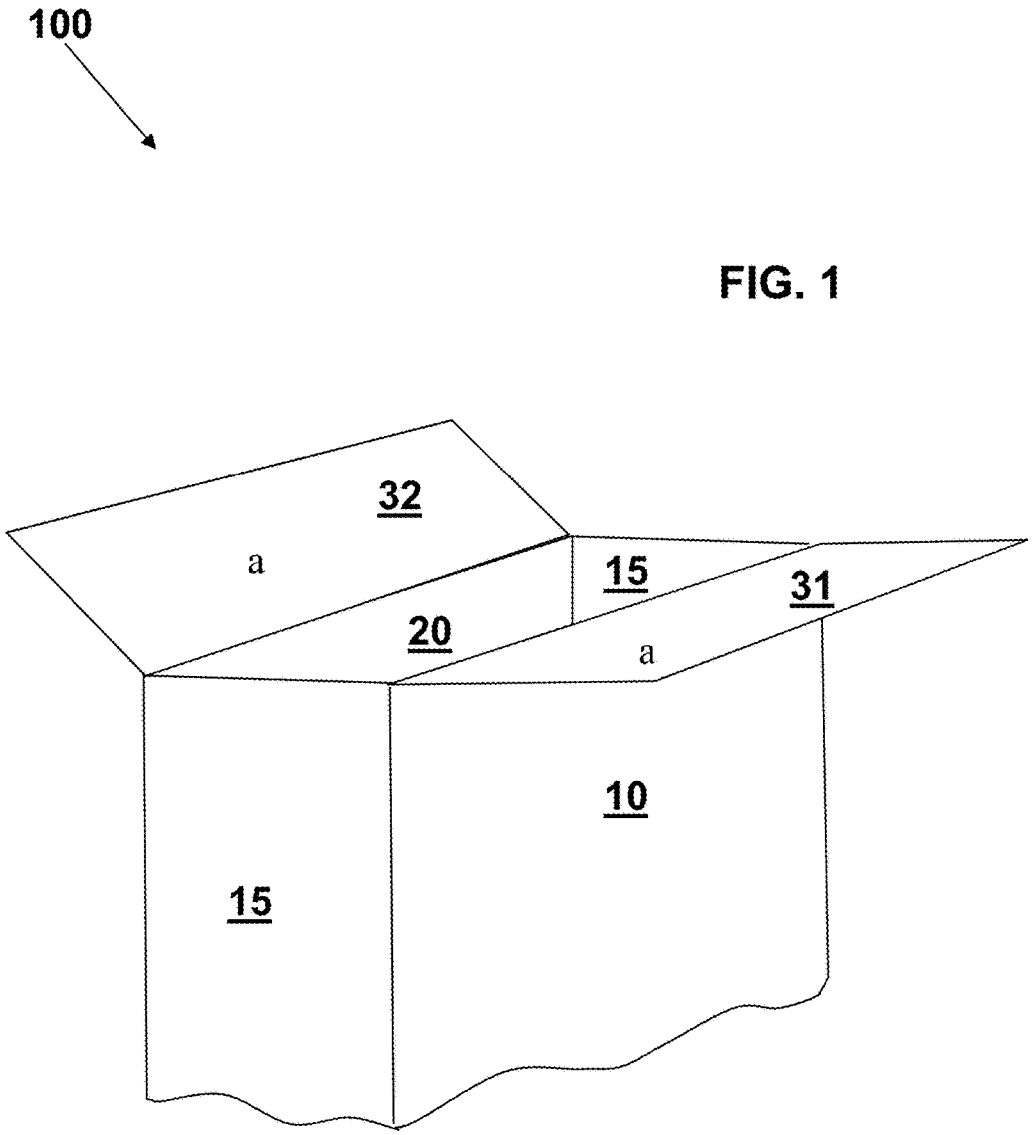
FIG. 1 is a perspective view of a packaging structure at its open end, before closing and sealing.

This package disclosed herein allows for multiple flaps or panels of a package to be glued and/or heat sealed simultaneously, with the application of glue on a level surface.

For ease of description, for packages with openings at the top, the 'lateral' portions of the package, such as the front, back, and sides, will be described as 'panels' while the 'end' portions of the package will be describes as 'flaps.' For certain packages described in herein, the larger portions of the package are described as 'panels' while certain of the smaller portions are described as 'flaps. These terms are meant only to facilitate description of the package, and not to limit in any way.

As will be described below, openings or holes may be cut into one or more of the package flaps so that when glue is applied to such flap, glue also moves through the holes and comes in contact with another flap or panel of the package. Once glue is applied in this fashion, the flaps can be folded over onto the glue, thereby fastening the flaps in one single glue application. The openings or holes also may provide advantageous contact between heat sealable coatings, when such coatings are used in place of or in addition to glue. In order to achieve a consistent sealing pressure and gluing surface, portions of the flaps, particularly portions in register with the openings or holes, may be embossed to create a raised area that fits into the openings and provides a flush (or relatively more flush) surface for gluing. If heat sealing is done, in addition or as an alternative to gluing, the openings and/or embossed areas also provide advantages of better sealing.

By embossing certain areas of the flaps or panels, a level gluing surface is created, creating more optimal adhesion properties than if these flaps and or panels had to be glued on multiple levels. This avoids less optimal gluing or adhesion that may result if the gluing surface is not flat, resulting in inconsistent pressure application during the set time for the adhesive. Thus by achieving more consistent pressure application during the set time, it may be possible to avoid weak gluing or adhesion points as might result in lower pressure areas.

As various embodiments of a first type of package are described, reference will be made to FIGS. 1-17. Certain parts of the packages are denoted by reference numerals. Where there is more than one of the same feature, generally only one will be denoted by a reference numeral. If different packages have a common feature, it may only be described one time.

Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. The packages described here may be made from one or several blanks (that is, the cut sheet parts from which the package components are made by folding and other steps).

FIG. 1 shows a perspective view of the open end of a package 100. The package may have a front panel 10 and a back panel 20 and side panels 15. End flaps 31, 32 may be hingedly attached to the front and back panels respectively. Side flaps (not shown) may also be provided.

The package 100 may be made from a sheet substrate such as paper or paperboard or other sheet material. The substrate may be made of or coated with materials to increase its strength. An example of such a sheet material is NATRALOCK paperboard made by MeadWestvaco Corporation. The sheet material may have a heat sealable coating, for example to allow a heat seal to be created between certain portions. Alternately, other forms of adhesive may be used to seal these portions together. It should be noted that the use of tear resistant materials, and/or in more than one layer, help to improve the tamper- and theft-resistance of the package. For example such a coating or treatment may be on the surface of the substrate that will become the interior of the package. This surface (e.g. the surface generally making up the interior of the package, and optionally treated for good sealing, may be denoted "a" in certain of the Figures herein. Alternately this inside surface may be left untreated, which might provide a better sealing surface than some coated surfaces, for example those with coatings optimized for printing, or glossy coatings. This sealing surface "a" will be described as the 'heat sealable' surface for ease of description, but not to limit the nature of the sealing surface, which, for example, could be treated by a heat sealable coating, could be treated by a tear-resistant coating or film, or other functional coating, or could be treated by both a heat sealable coating or film and tear resistant coating or film (possibly as a single coating or film), or could be left untreated.

The substrate may be coated on one surface, for example the surface that will become the outside of the package, with a coating suited for printing graphics.

Figure 2:
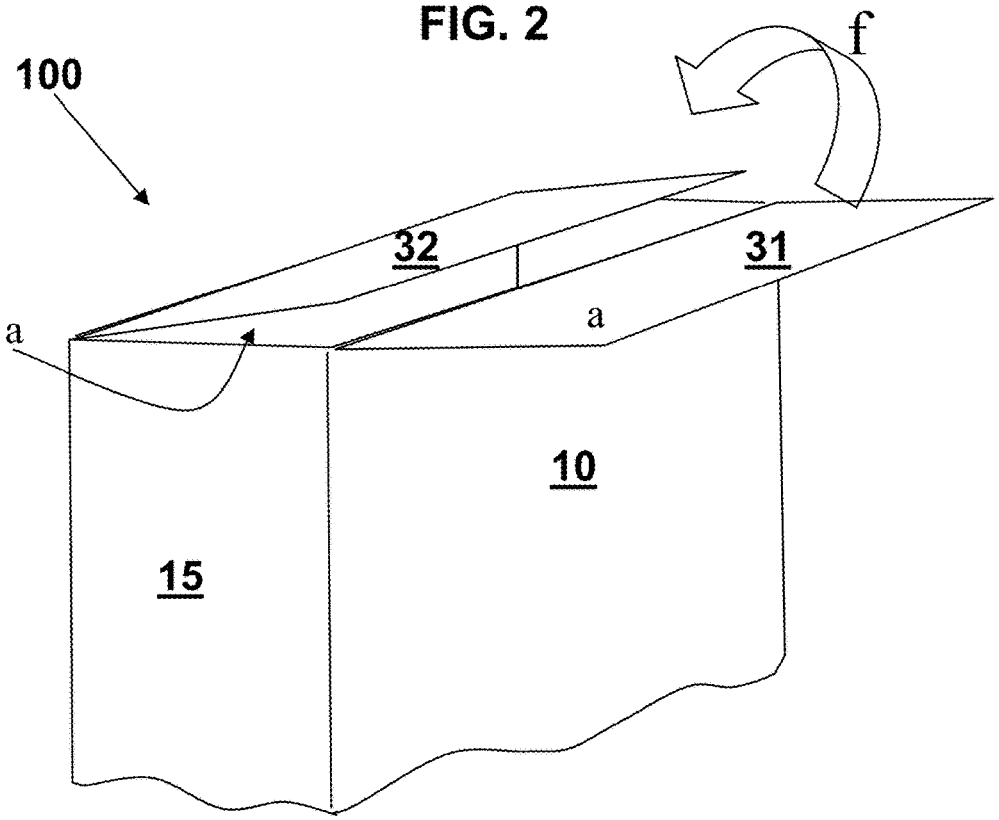
FIG. 2 is a perspective view of a packaging structure at its open end, in a partly closed configuration.

FIG. 2 shows a step in closing and the package with back end flap 32 folded inward, and arrow "f" showing a subsequent folding operation that would close the package. However, with this particular package design, the heat seal surface "a" of front end flap 31 does not contact the heat seal surface "a" of back end flap 32. It would be advantageous if contact could be made between the heat seal surfaces "a" of the flaps.

Figure 3:
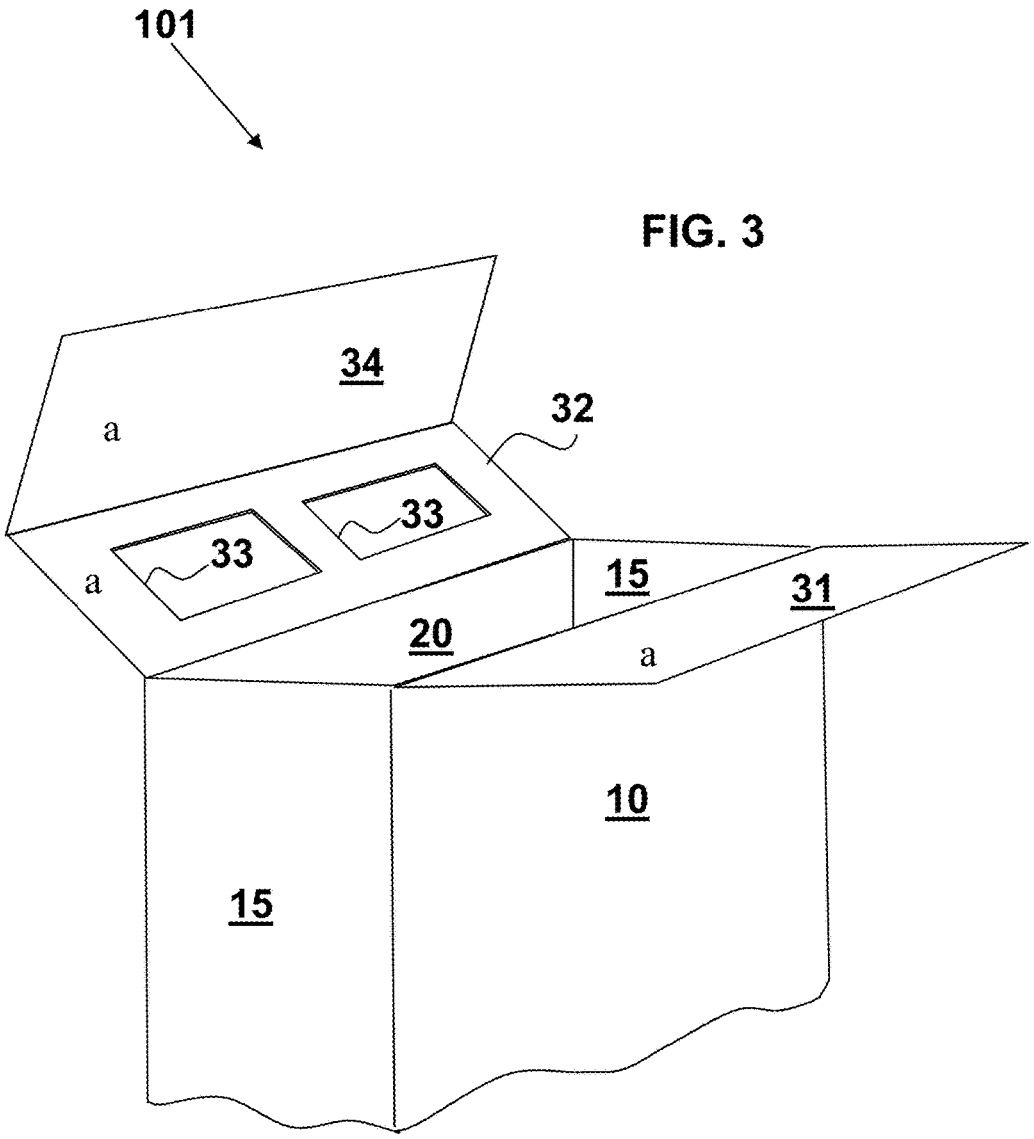
FIG. 3 is a perspective view of an improved packaging structure at its open end, before closing and sealing.

FIG. 3 shows a similar package 101. Here the back end flap 32 has one or more openings 33. Also, hingedly attached to back end flap 32 is back end flap extension 34. Again certain heat seal surfaces "a" are denoted.

Figure 4:
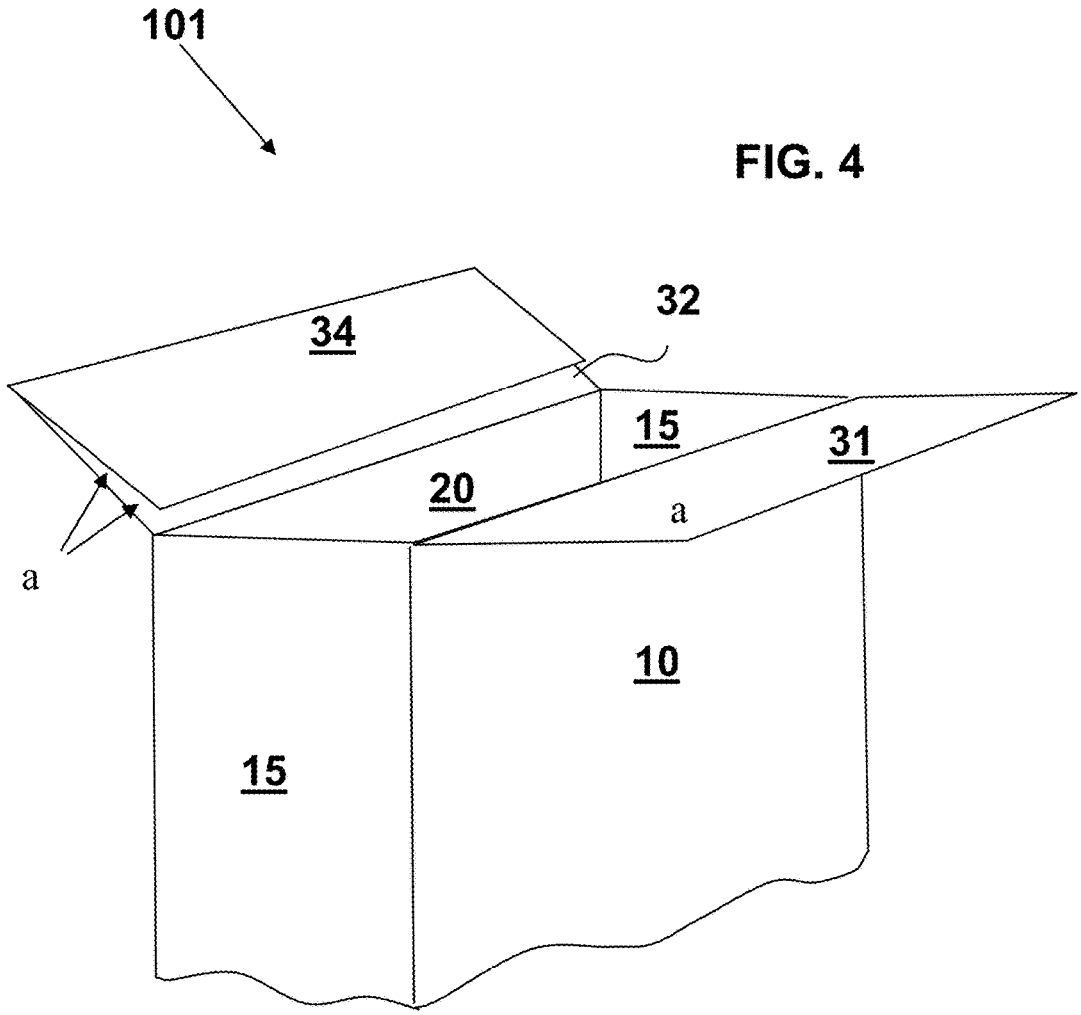
FIG. 4 is a perspective view of the package of FIG. 3, at one stage of its closing and sealing.

FIG. 4 shows the package after the back end flap extension 34 is folded inward and over upon back end flap 32. It will be noted that this places the heat seal surfaces "a" of back end flap 32 and back end flap extension 34 in contact with each other, which may be advantageous for good sealing between these surfaces.

Figure 5:
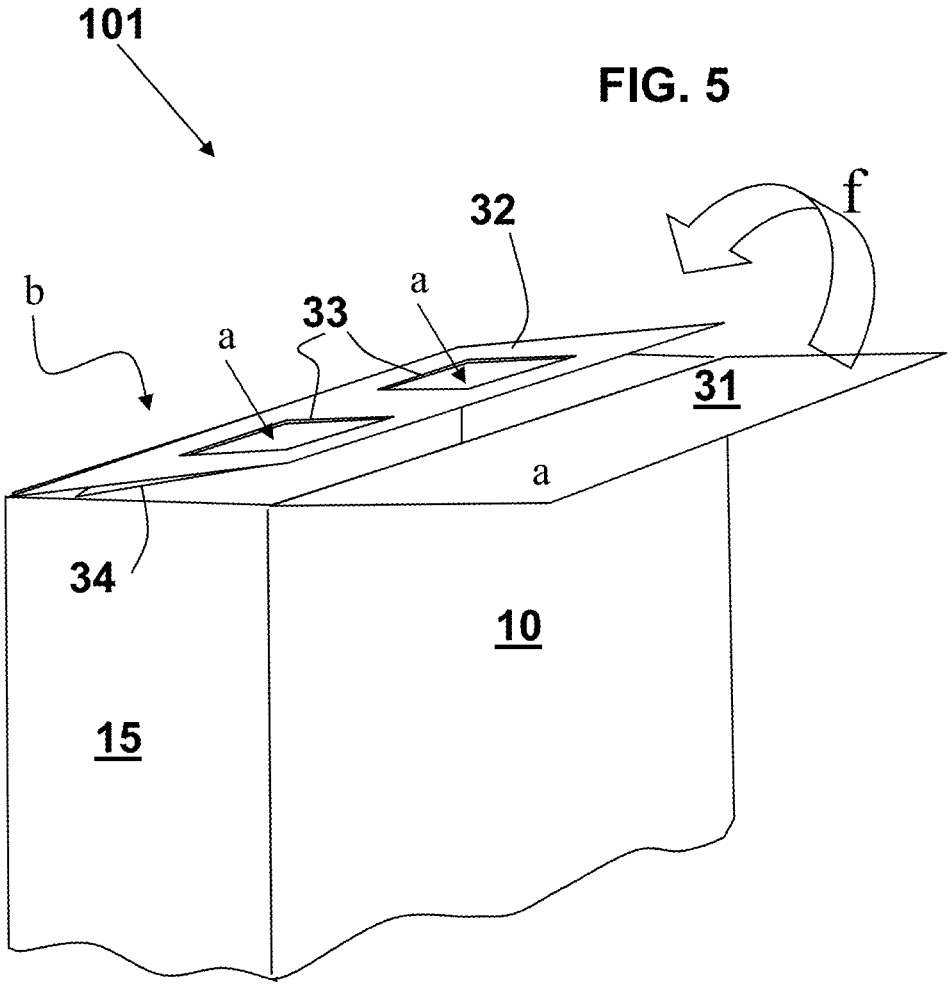
FIG. 5 is a perspective view of the package of FIG. 4, at a further stage of its closing and sealing.

FIG. 5 shows the package after the two-ply structure of flaps 32, 34 is folded inward over the opening in the package. Because of the openings 33 provided in back end flap 32, certain heat seal surfaces "a" from back end flap extension 34 are exposed (e.g. facing outward). This provides some sealing contact area between heat seal surfaces "a" of the back end flap extension 34, and the front end flap 31, once the front end flap is closed according to motion "f." However it will be noted that with the thickness of back end flap 32 intervening between back end flap extension 34 and front end flap 31, direct contact of the heat seal surfaces "a" may not be completely achieved. Thus depending on the method of sealing, additional pressure, higher temperature, longer dwell time, or more adhesive or glue may be required to achieve a desired seal.

Figure 6A:
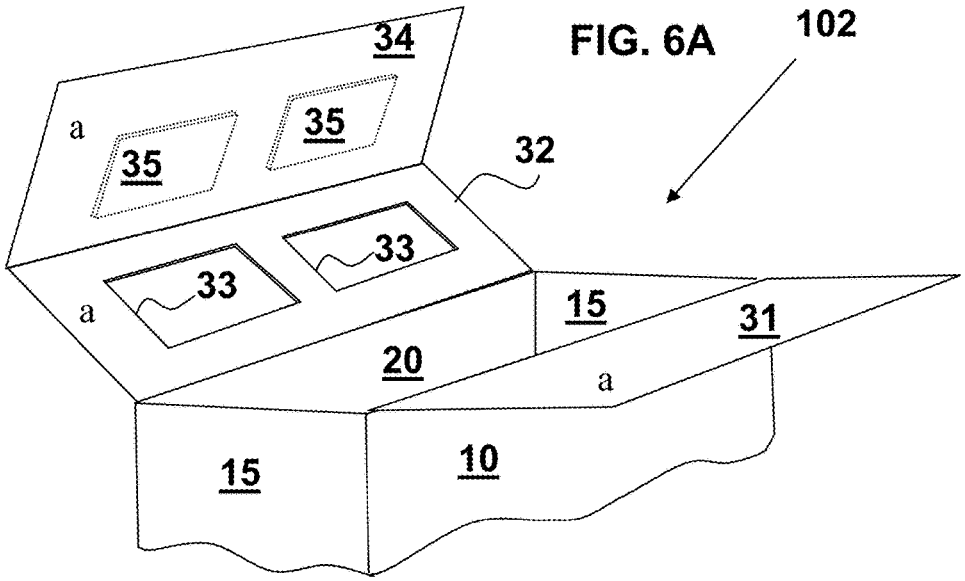
FIGS. 6A and 6B are perspective views of other versions of the package of FIG. 3, before closing and sealing.

FIG. 6A shows an alternative package 102 where back end flap extension 34 is provided with embossed areas 35 that will fit into openings 33 in the back end flap, once the flaps 32, 34 are folded together. Thus the overall upper surface of these panels, designated "b" in FIG. 5, may be more uniformly level and may make better contact with the heat seal surface "a" of front end flap 31. In particular, the embossed areas 35 may be in better contact with the heat seal surface "a" of front end flap 31.

Figure 6B:
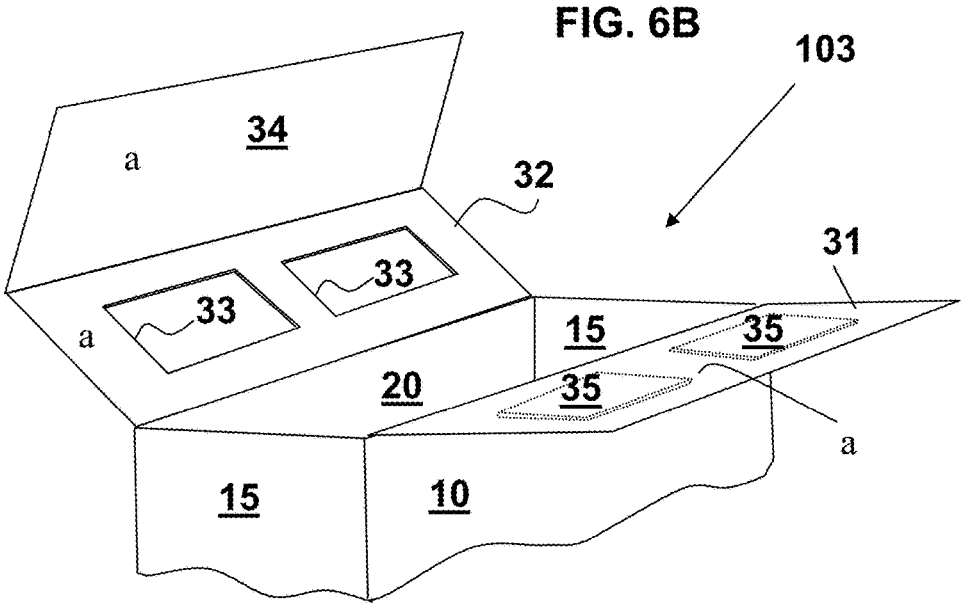

FIG. 6B shows another package 103 where, instead of providing embossed areas on the back end flap extension 34, embossed areas 35 may be provided on the front end flap 31, which will fit into the openings 33 once the end flaps are closed. Again, this may provide a more uniformly level surface between the flaps and may improve sealing.

Figure 7:
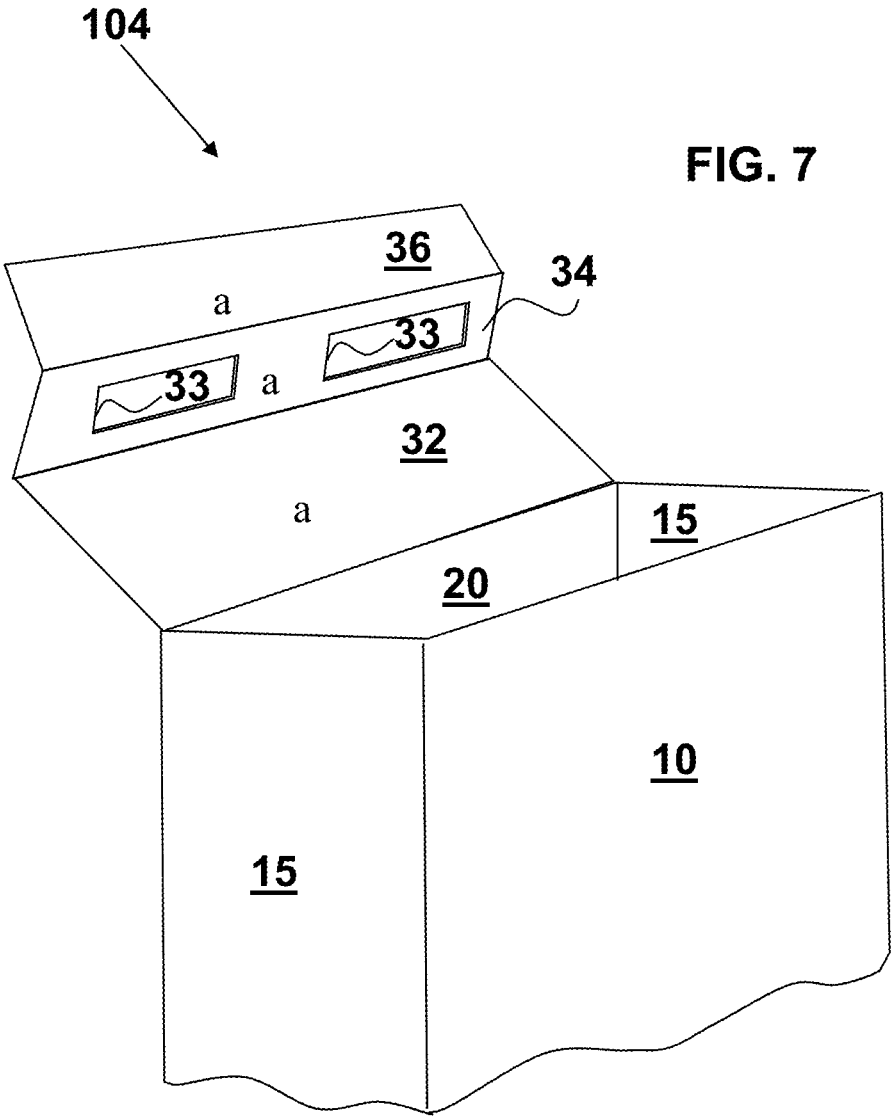
FIG. 7 is a perspective view of another package before closing and sealing.

FIG. 7 shows another package 104. Here the back end flap 32 has a hingedly attached first back end flap extension 34, which has one or more openings 33. Further, hingedly attached to first back end flap extension 34 is second back end flap extension 36. Again certain heat seal surfaces "a" are denoted.

Figure 8:
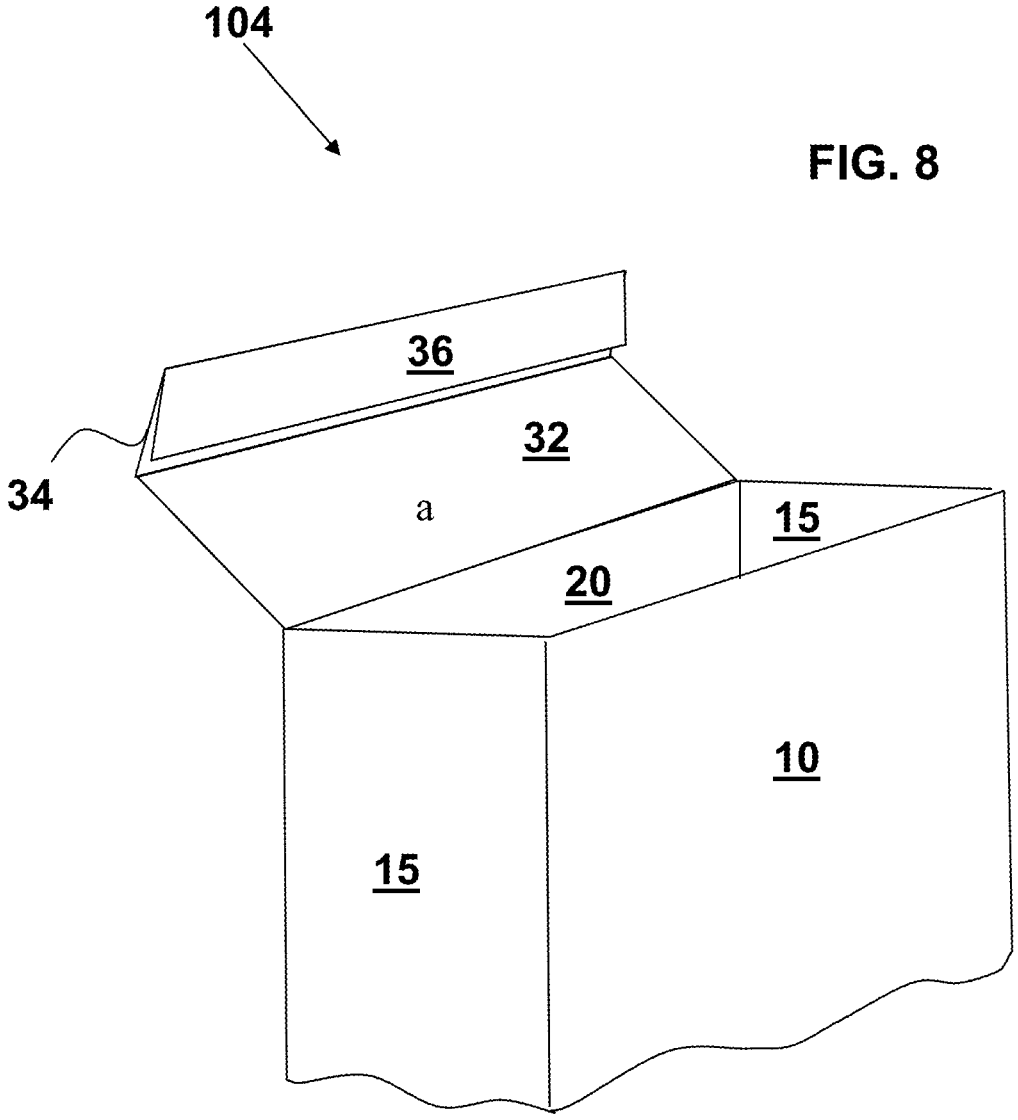
FIG. 8 is a perspective view of the package of FIG. 7, at one stage of its closing and sealing.

FIG. 8 shows the package after the second back end flap extension 36 is folded forward over back end flap extension 34 to close the package. It will be noted that this places the heat seal surfaces "a" of flap extension 34, 36 in contact with each other, which may be advantageous for good sealing between these surfaces.

Figure 9:
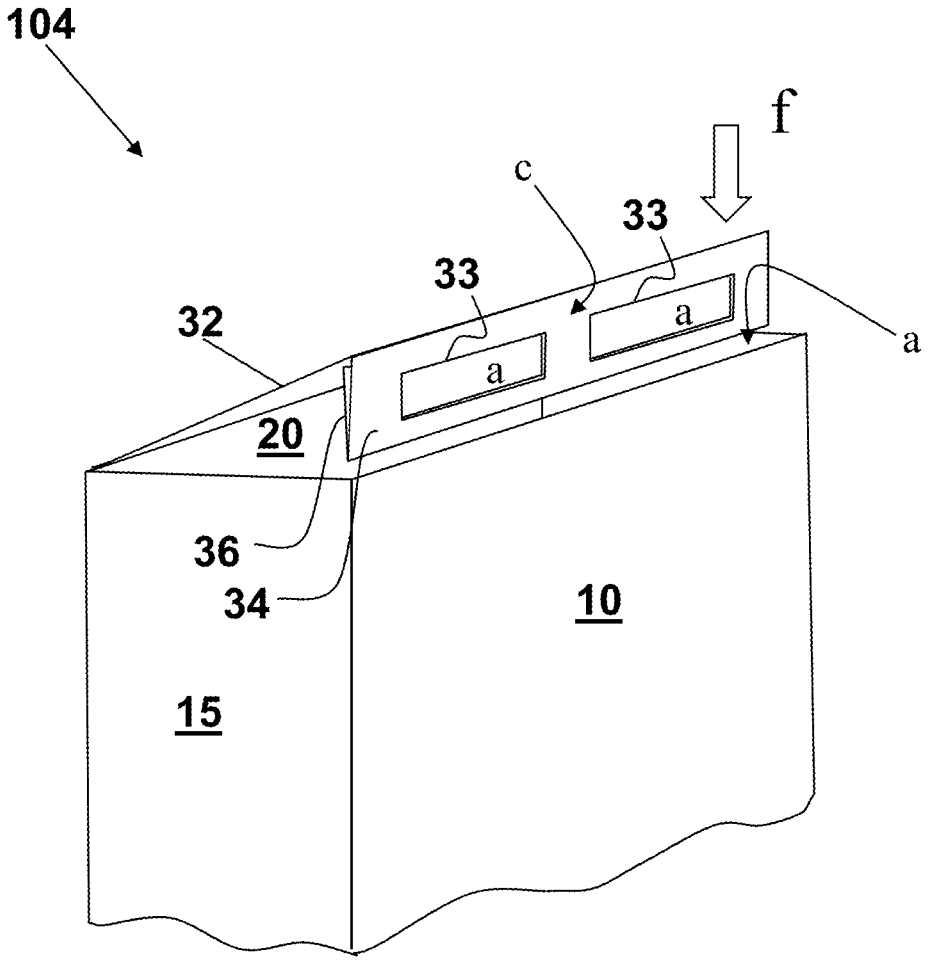
FIG. 9 is a perspective view of the package of FIG. 7, at a further stage of its closing and sealing.

FIG. 9 shows the package after the back end flap 32 is folded forward over the opening in the package along with the two-ply structure of flaps 34, 36. Because of the openings 33 provided in first back end flap extension 34, certain heat seal surfaces "a" from second back end flap extension 36 are exposed (e.g. facing outward/forward). This provides some sealing contact area between heat seal surfaces "a" of the second back end flap extension 36, and upper inside of front panel 10, once the package is closed according to motion "f." However it will be noted that with the thickness of first back end flap extension 34 intervening between second back end flap extension 36 and front panel 10, direct contact of the heat seal surfaces "a" may not be completely achieved. Thus depending on the method of sealing, additional pressure, higher temperature, longer dwell time, or more adhesive or glue may be required to achieve a desired seal.

Figure 10A:
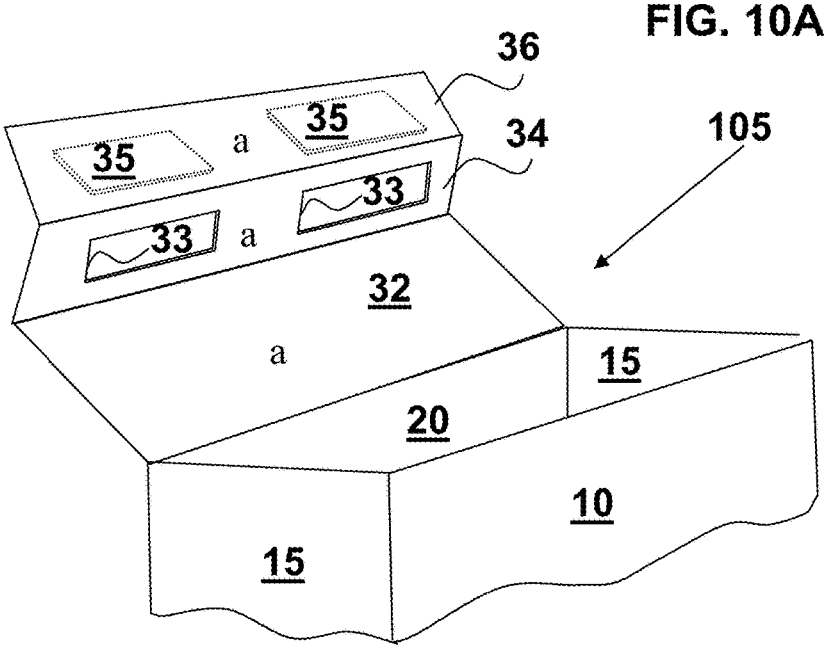
FIGS. 10A and 10B are perspective views of other versions of the package of FIG. 7, before closing and sealing.

FIG. 10A shows an alternative package 105 where second back end flap extension 36 is provided with embossed areas 35 that will fit into openings 33 in the first back end flap extension, once the flaps 34, 36 are folded together. Thus the overall outer/front surface of these panels, designated "c" in FIG. 9, may be more uniformly level and may make better contact with the heat seal surface "a" inside front panel 10. In particular, the embossed areas 35 may be in better contact with the heat seal surface "a" of front panel 10.

Figure 10B:
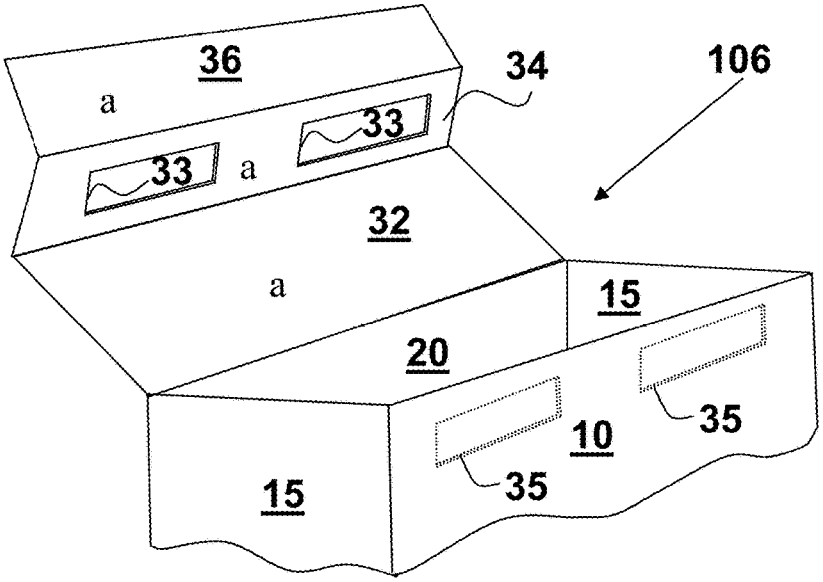

FIG. 10B shows another package 106 where, instead of providing embossed areas on the second back end flap extension 34, embossed areas 35 may be provided on the front panel 10, which will fit into the openings 33 once the package is closed. Again, this may provide a more uniformly level surface between the flaps and panel and may improve sealing.

Figure 11:
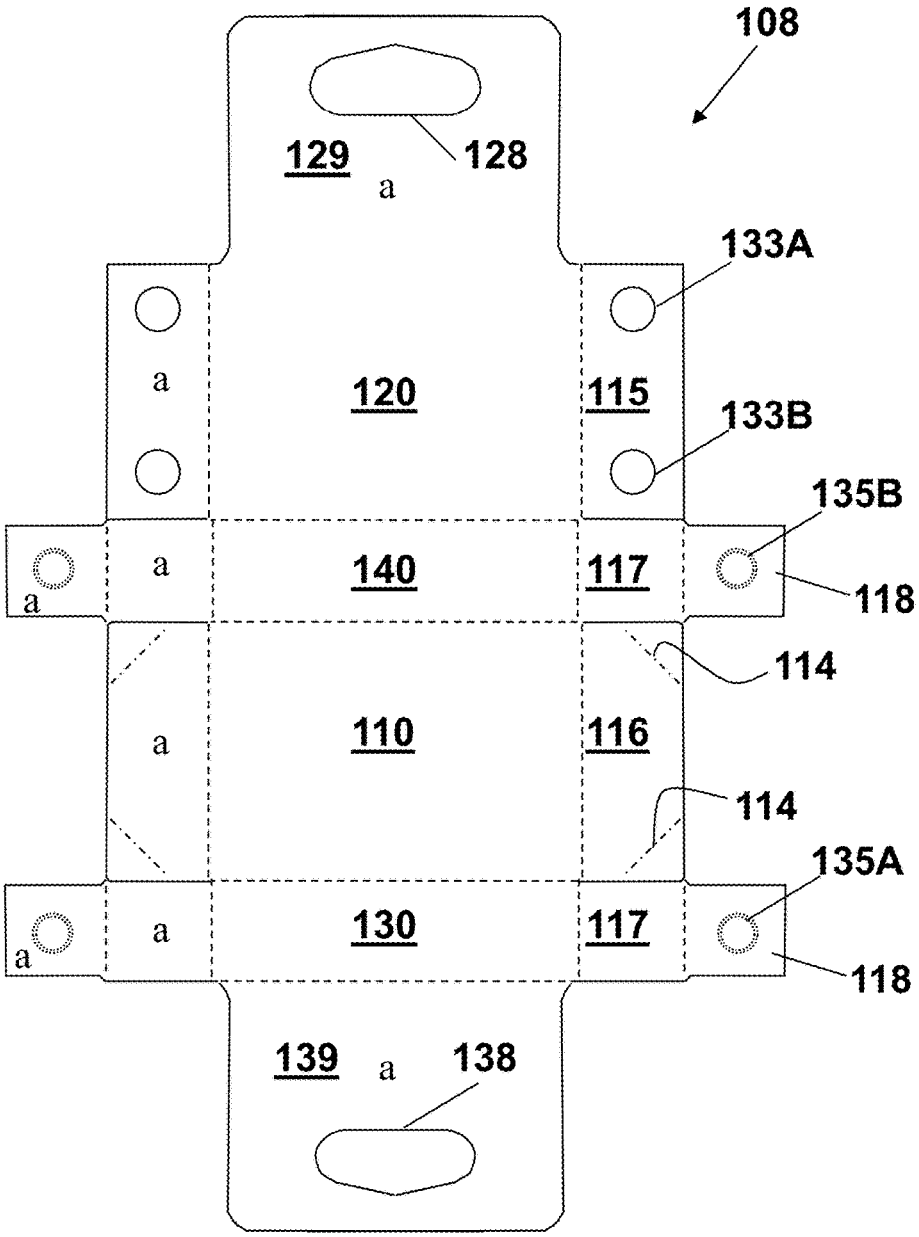
FIG. 11 is a plan view of a blank for making another version of a package.

FIG. 11 shows a plan view of a blank 108 for making a package. This example package uses features similar to those of FIGS. 3 through 10, but the sealing flaps utilizing these features are on the sides rather than the ends of the package. The package may have a front panel 110 and a back panel 120 with top panel 130 and bottom panel 140. The back panel 120 may have attached a back panel extension 129 with optional hang hole 128. The top panel 130 may have hingedly attached a top extension panel 139 with optional hang hole 138.

Side panels and flaps may be provided as follows, starting from the upper (back) of the blank as shown in FIG. 11 (only one side described here): inner side panel 115, side flap 117 with hingedly attached side flap extension 118, outer side panel 116, and another side flap 117 with hingedly attached side flap extension 118. The inner side panel 115 may include openings 133A, 133B while the side flap extensions 118 may include embossed areas 135A, 135B which may be embossed 'upward" (out of drawing). The heat seal surface "a" faces upward as shown in FIG. 11, and certain areas will be denoted as "a" to remind the reader which surface they represent.

Figure 12:
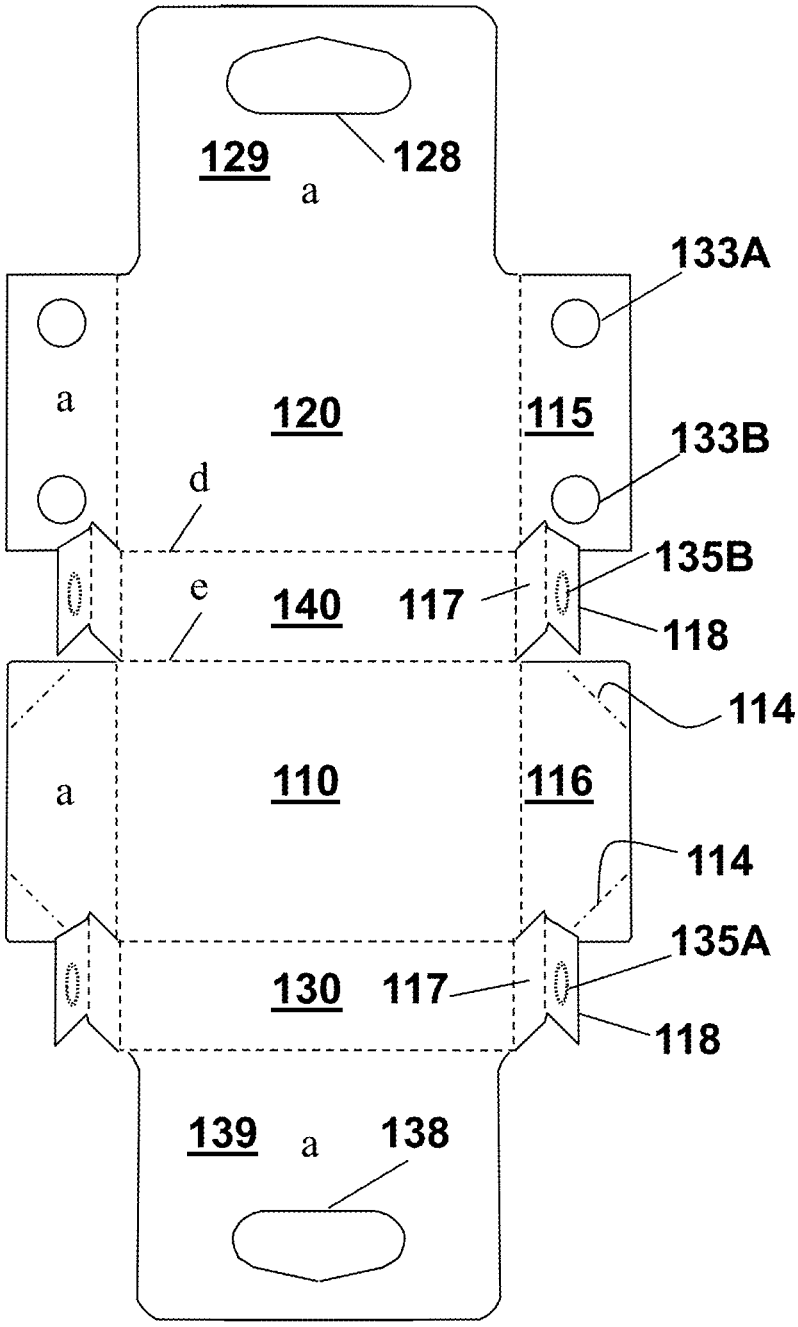
FIGS. 12-14 are perspective views of the package of FIG. 11 during its assembly.

FIG. 12 shows a first step in constructing the package, where the side flaps 117 and their side flap extensions 118 are folded upward (out of the page). Note that this places the embossed areas 135A, 135B facing laterally outward, that is, toward the outside of the eventual package. Advantageously the embossed areas are now "raised outward" with respect to the package structure.

Figure 13A:
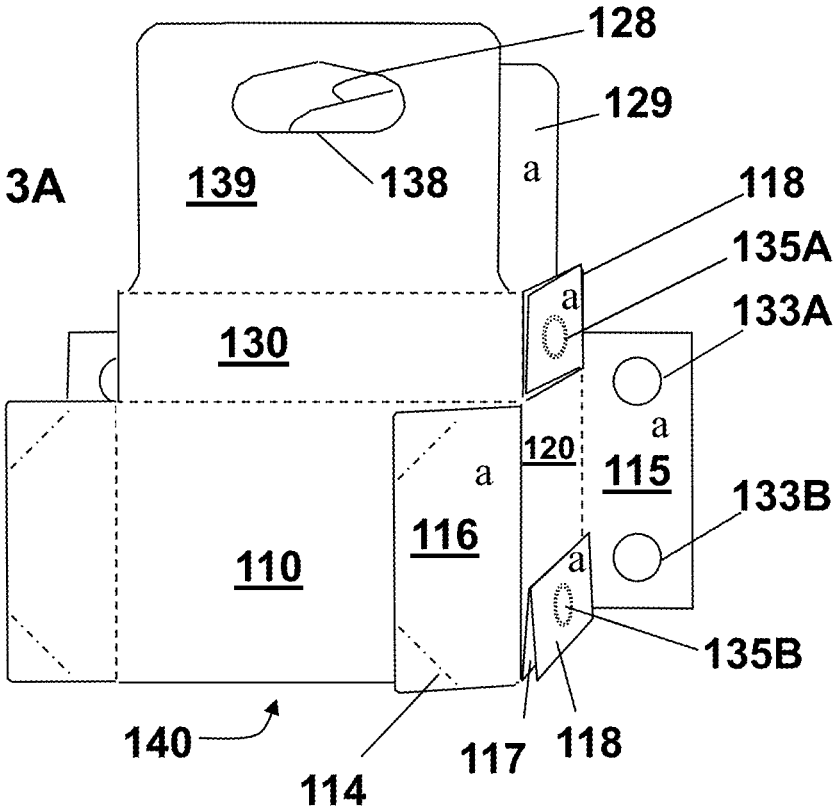

FIG. 13A shows a further step in constructing the package reached by folding along lines d, e of FIG. 12, to create a partially folded package with open sides and top. Thus as shown in FIG. 13A, the front panel 110, top panel 130, and top extension panel 139 now face forward, the lower side flaps 117 and lower side flap extension 118 face upward from their hinged attachment to bottom panel 140, and the upper side flaps 117 and upper side flap extensions 118 face backward from their hinged attachment to top panel 130. The outer side panel 116 has been folded forward toward the viewer for a clearer view of the flaps. It will be noted that the embossed areas 135A, 135B still face laterally outward.

Figure 13B:
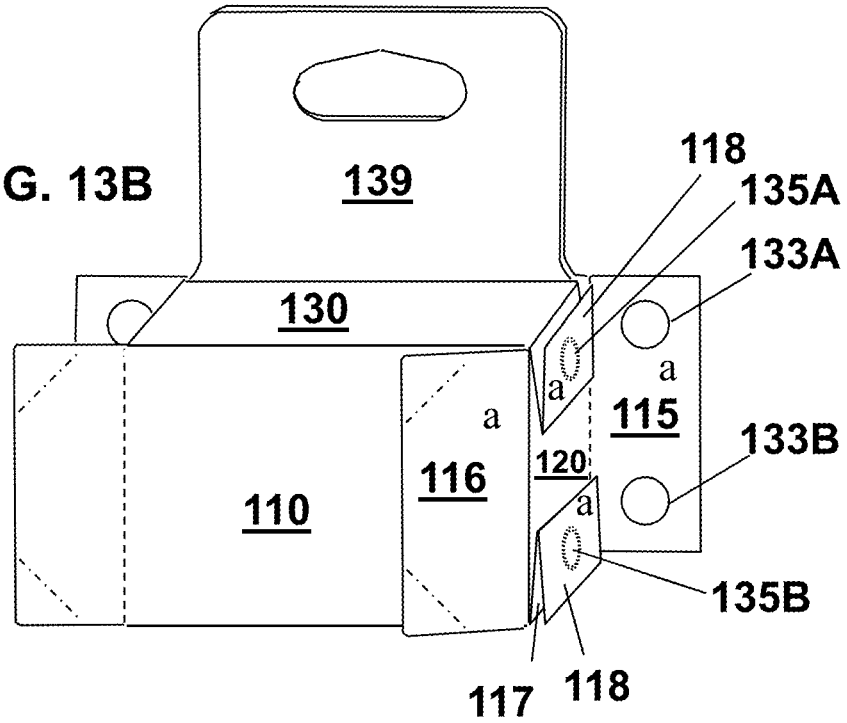

FIG. 13B shows a further step in constructing the package, reached by folding the top panel 130 backward and the top extension panel 139 upward. At this point if desired the back panel extension 129 and the top extension panel 139 may be sealed together. The upper side flaps 117, 118 now face downward from their hinged attachment to top panel 130. Note the position of sealing surfaces "s" of the inner side panel 115, side flap extensions 118, and outer side panel 116.

Figure 14A:
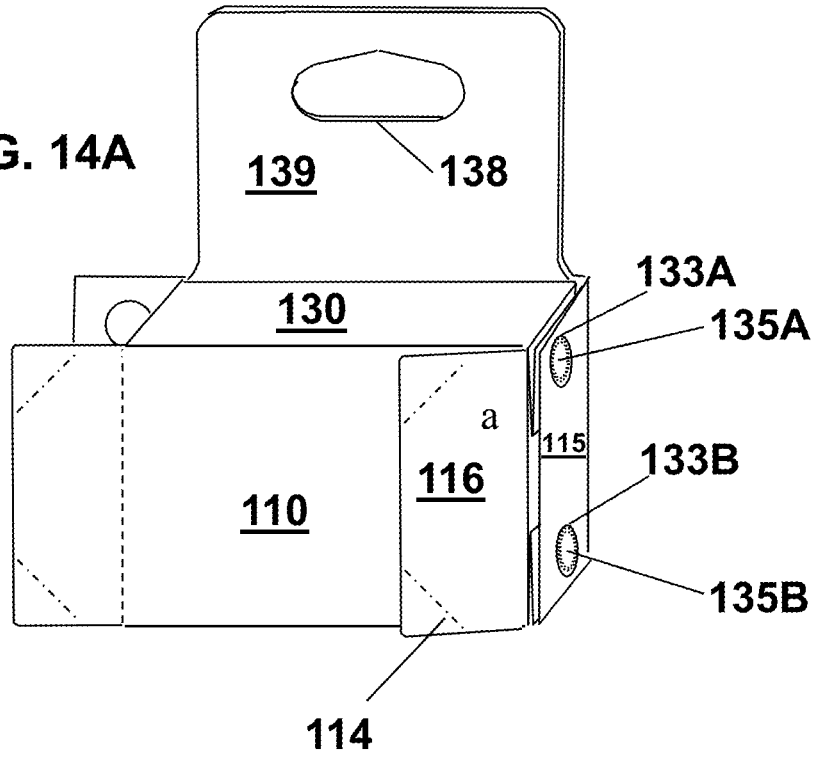

FIG. 14A shows a further step in constructing the package, reached by folding the inner side panel 115 forward over the side flap extensions 118, which places the heat seal surfaces "a" of the inner side panel 115 and the side flap extensions 118 in contact with each other (as is evident from FIG. 13B). Thus good sealing may be achieved between these surfaces. It is further noted that the embossed areas 135A, 135B align with the openings 133A, 133B respectively. Preferably these areas are embossed 'outward' so that the level of these embossed areas 135A, 135B is approximately the level of the outer surfaces of inner side panel 115. Thus a relatively flat surface is presented by inner side panel 115 and embossed areas 135A, 135B to make contact with the heat seal surface "a" of outer side panel 116 which will be folded next. Furthermore the embossed areas 135A, 135B are also heat seal surfaces "a" as is evident from following the assembly steps of FIGS. 11-14.

Figure 14B:
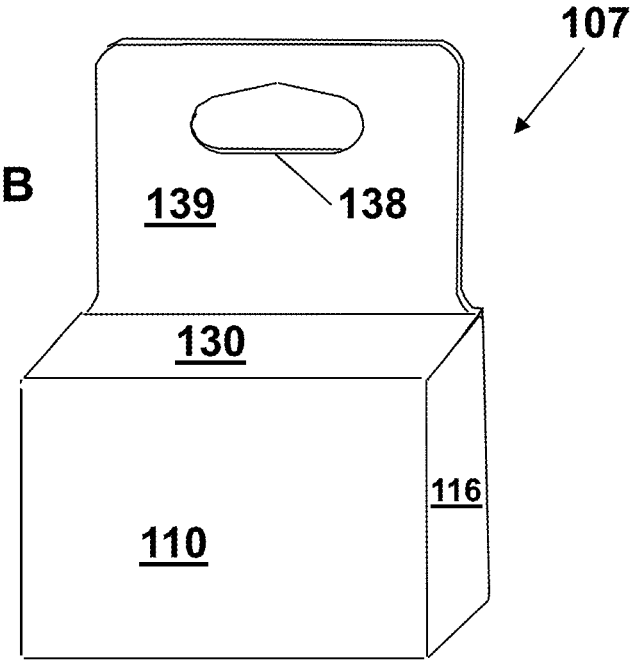
Figure 15A:
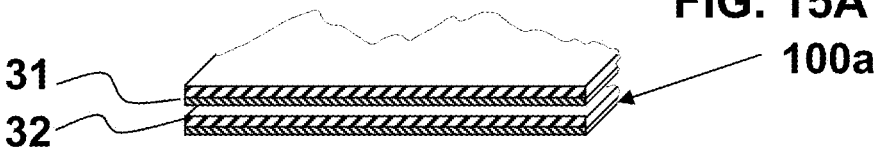
FIGS. 15-17 are cross section detail views of sealing surfaces for the packages of FIGS. 1-14.
Figure 15B:
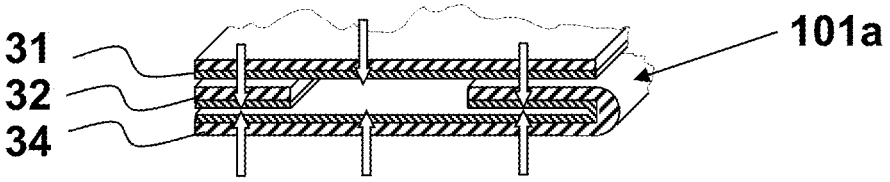
Figure 15C:
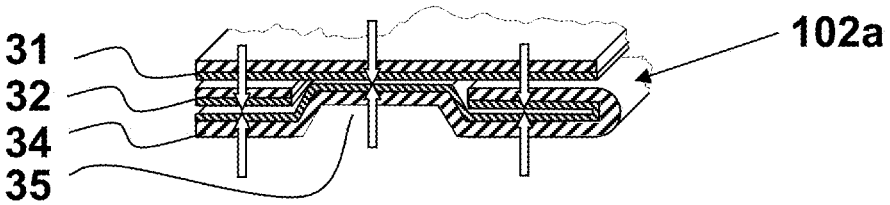
Figure 15D:
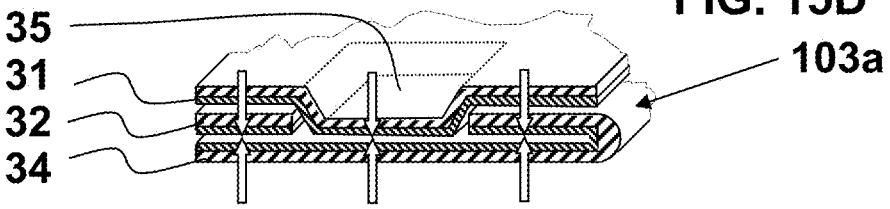
Figure 15E:
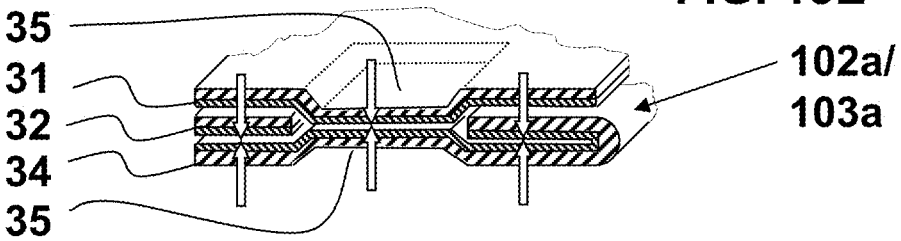
Figure 16A:
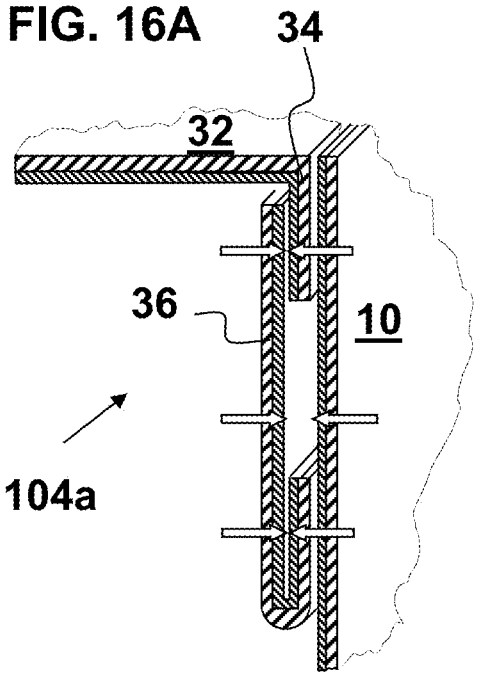
Figure 16B:
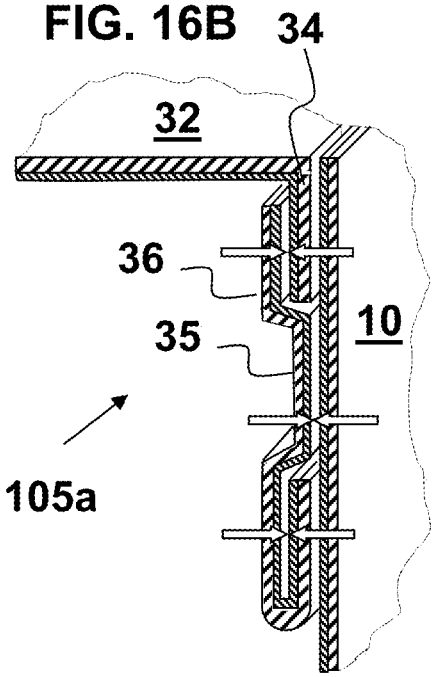
Figure 16C:
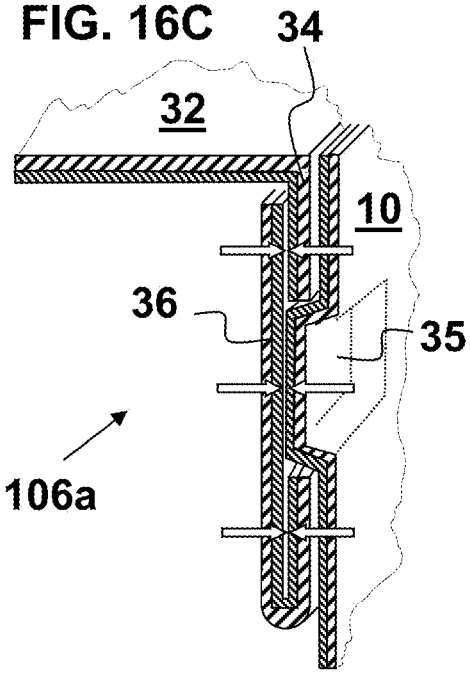
Figure 16D:
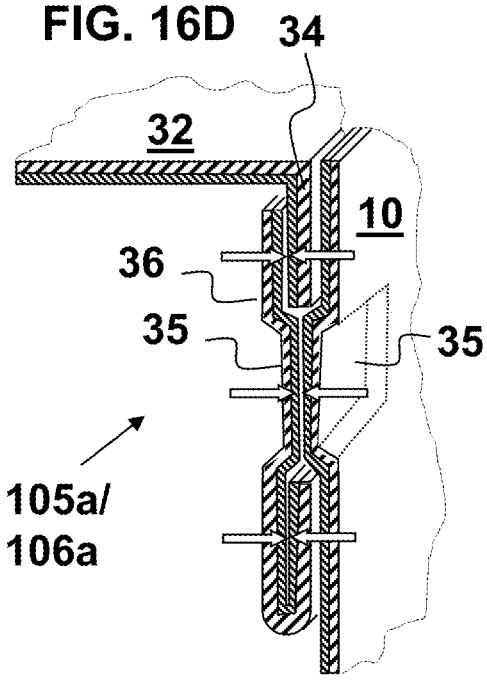

In FIG. 14B, the outer side panel 116 has been folded back to form the closed package 107. (The other side of the package is now also shown closed). As is evident from FIG. 14A, the heat seal surfaces of embossed areas 135A, 135B will now be in contact with the heat seal surface "a" of outer side panel 116, for a stronger seal.

Referring again to FIG. 14A, perforated lines 114, extending partly or fully through the panel, may be provided on outer side panels 116 as tear stops to help prevent unauthorized opening or tearing into the package. If the perforations extend only partly through the panel, they may at least extend through a tear resistant coating if one is used. The perforations may be located on the inner (hidden) surface of the side panel 116, or on an outer surface. The adjacent corners of the outer side panel 116 make contact with corresponding corners of inner side panel 115, whose outer surface is not a heat seal surface "a". Thus it is possible that the sealing here may be incomplete or weaker than at some other points of the package. If the corners of the outer side panels 116 are weakly or incompletely sealed in the final package, it may be possible to pull on these corners and start a tear into the package. However, upon reaching the perforated line 114, the corner is likely to be torn off before the tear can progress further, thus halting the intrusion into the package.

FIG. 15 shows cross section (edge) detail views 104*a*-103*a* of the 'sealing' flap surfaces of the various packages 100-103 respectively, and also an additional variation in view 102*a*/103*a*. The substrate edge is illustrated as a thickness of white material, while the edge of the heat seal surface is illustrated as a black line. White arrows indicate points where direct contact may be made between heat seal surfaces.

The sealing flap structure 100*a* provides no direct contact between the heat seal surfaces of front end flap 31 and back end flap 32.

The sealing flap structure 101*a* provides a direct contact between the heat seal surfaces of back end flap 32 and back end flap extension 34, and also provides for direct contact between the heat seal surfaces of front end flap 31 and back end flap extension 34, via the opening in back end flap 32. To obtain a good seal between the heat seal surfaces of front end flap 31 and back end flap extension 34, sufficient pressure should be applied to bring these surfaces together through the opening, or sufficient heat seal coating or hot melt glue provided to bridge the gap through that opening.

The sealing flap structure 102*a* provides a direct contact between the heat seal surfaces of back end flap 32 and back end flap extension 34, and also provides for direct contact between the heat seal surfaces of front end flap 31 and back end flap extension 34, via the opening in back end flap 32. Furthermore an embossed area 35 provided in the back end flap extension 34 brings the heat seal surfaces of front end flap 31 and back end flap extension 34 closer together to facilitate making a good seal.

The sealing flap structure 103*a* provides a direct contact between the heat seal surfaces of back end flap 32 and back end flap extension 34, and also provides for direct contact between the heat seal surfaces of front end flap 31 and back end flap extension 34, via the opening in back end flap 32. Furthermore an embossed area 35 provided in the front end flap 31 brings the heat seal surfaces of front end flap 31 and back end flap extension 34 closer together to facilitate making a good seal.

The sealing flap structure 102*a*/103*a* provides a direct contact between the heat seal surfaces of back end flap 32 and back end flap extension 34, and also provides for direct contact between the heat seal surfaces of front end flap 31 and back end flap extension 34, via the opening in back end flap 32. Furthermore embossed areas 35 provided in the front end flap 31 and back end flap extension 34 bring the heat seal surfaces of front end flap 31 and back end flap extension 34 closer together to facilitate making a good seal.

FIG. 16 shows cross section (edge) detail views 104*a*-106*a* of the 'sealing' flap surfaces of the various packages 104-106 respectively, and also an additional variation in view 105*a*/106*a*. The substrate edge is illustrated as a thickness of white material, while the edge of the heat seal surface is illustrated as a black line. White arrows indicate points where direct contact may be made between heat seal surfaces.

The sealing flap structure 104*a* provides a direct contact between the heat seal surfaces of first back end flap extension 34 and second back end flap extension 36, and also provides for direct contact between the heat seal surfaces of front panel 10 and second back end flap extension 36, via the opening in first back end flap extension 34. To obtain a good seal between the heat seal surfaces of front panel 10 and second back end flap extension 36, sufficient pressure should be applied to bring these surfaces together through the opening, or sufficient heat seal coating or hot melt glue provided to bridge the gap through that opening.

The sealing flap structure 105*a* provides a direct contact between the heat seal surfaces of second back end flap extension 36 and first back end flap extension 34, and also provides for direct contact between the heat seal surfaces of front panel 10 and second back end flap extension 36, via the opening in first back end flap extension 34. Furthermore an embossed area 35 provided in the second back end flap extension 36 brings the heat seal surfaces of front panel 10 and second back end flap extension 36 closer together to facilitate making a good seal.

The sealing flap structure 106*a* provides a direct contact between the heat seal surfaces of second back end flap extension 36 and first back end flap extension 34, and also provides for direct contact between the heat seal surfaces of front panel 10 and second back end flap extension 36, via the opening in first back end flap extension 34. Furthermore an embossed area 35 provided in the front panel 10 brings the heat seal surfaces of front panel 10 and second back end flap extension 36 closer together to facilitate making a good seal.

The sealing flap structure 105*a*/106*a* provides a direct contact between the heat seal surfaces of second back end flap extension 36 and first back end flap extension 34, and also provides for direct contact between the heat seal surfaces of front panel 10 and second back end flap extension 36, via the opening in first back end flap 34. Furthermore embossed areas 35 provided in both of the front panel 10 and second back end flap extension 36 bring the heat seal surfaces of front panel 10 and second back end flap extension 36 closer together to facilitate making a good seal.

Figure 17:
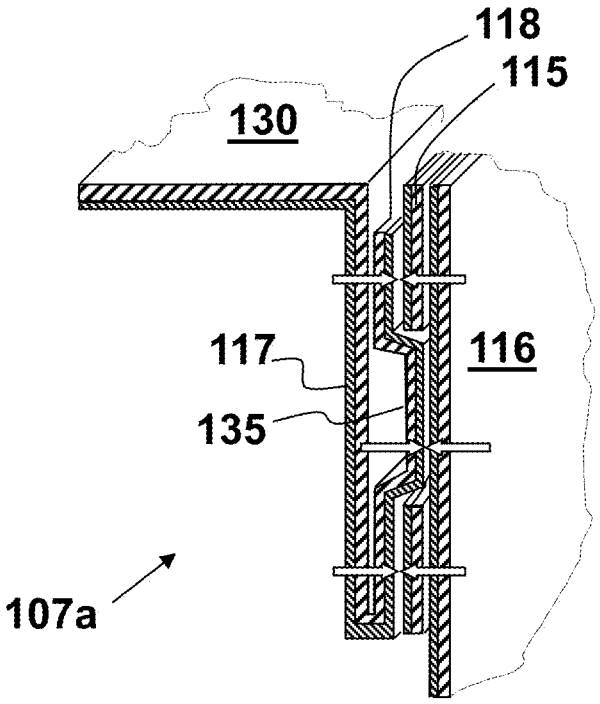

FIG. 17 shows cross section (edge) detail view 107*a* of the 'sealing' flap surfaces of the package 107. Other arrangements are possible, such as having the embossed area 135 located on outer side panel 116, or located on both of outer side panel 116 and side flap extension 118. The substrate edge is illustrated as a thickness of white material, while the edge of the heat seal surface is illustrated as a black line. White arrows indicate points where direct contact may be made between heat seal surfaces.

The sealing flap structure 107*a* provides a direct contact between the heat seal surfaces of outer side panel 116 and inner side panel 115, and also provides for direct contact between the heat seal surfaces of outer side panel 116 and side flap extension 118, via the opening in inner side panel 115. The embossed area 35 provided in the side flap extension 118 brings the heat seal surfaces of side flap extension 118 and outer side panel 116 closer together to facilitate making a good seal.

Packages 100-107 may be used to enclose either a loose item of merchandise, or an inner carton enclosing merchandise. The packages may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Figure 18:
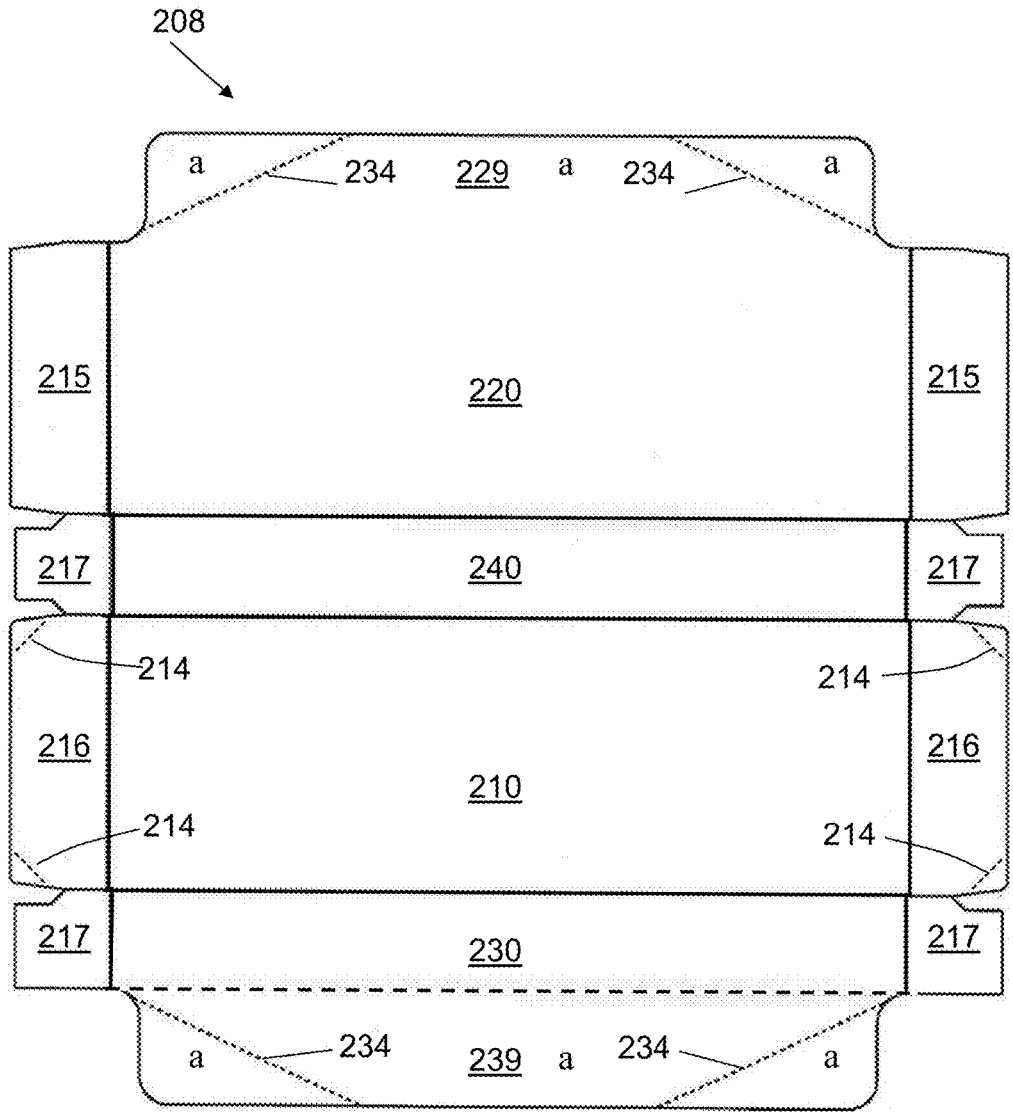
FIG. 18 is a plan view of a blank for making another version of a package.

FIG. 18 shows a plan view of a blank 208 for making another package and showing tear-diverting features 214 like those described earlier. The package may have a front panel 210 and a back panel 220 with top panel 230 and bottom panel 240. The back panel 220 may have attached a back panel extension 229. The top panel 230 may have hingedly attached a top extension panel 239. Panels 229, 239 may be provided with hang holes (not shown).

Side panels and flaps may be provided as follows, starting from the upper (back) of the blank as shown in FIG. 18 (only one side described here): inner side panel 215, side flap 217, outer side panel 216, and another side flap 117. The heat seal surface "a" faces upward as shown in FIG. 18, and certain areas will be denoted as "a" to remind the reader which surface they represent.

Figure 19A:
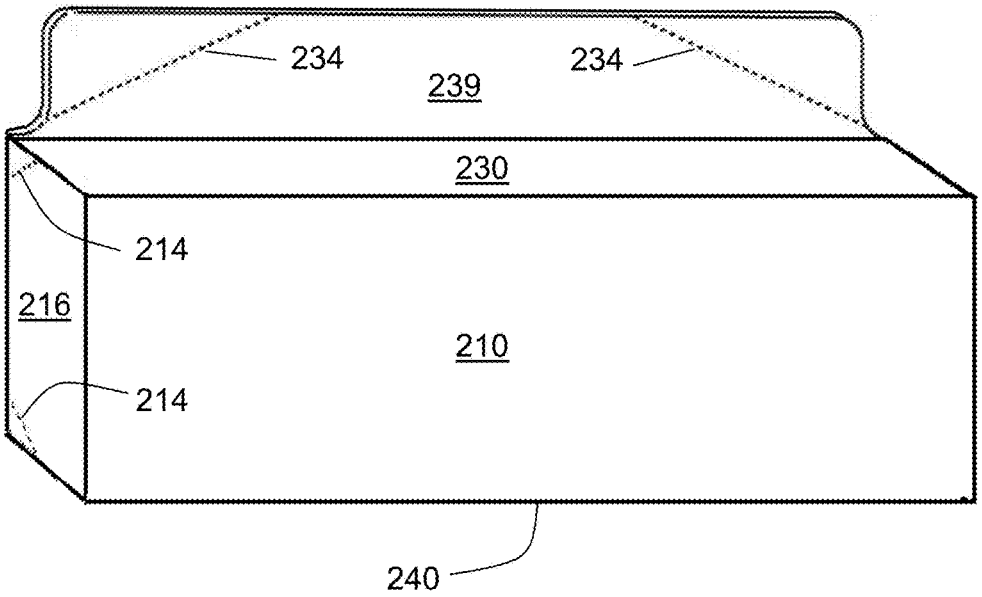
FIGS. 19A-19C are perspective views of the package of FIG. 18 after assembly and showing certain security features.

The blank shown in FIG. 18 may be folded to form a rectangular tube whose sides are panels 220, 240, 210, and 230 respectively. Panels 229, 239 may be sealed together forming an external longitudinal flap as shown in FIG. 19A. To close the ends of the tube, the side flaps 217 may be folded, followed by inner side panel 215, and finally outer side panel 216.

The construction shown in FIGS. 18 and 19A allows the heat sealable surfaces "a" of panels 229, 239 to face together. Thus good sealing may be achieved between these surfaces. Alternately, other forms of adhesive may be used to seal these portions together. It should be noted that the use of tear resistant materials, and/or in more than one layer, help to improve the tamper- and theft-resistance of the package. For example such a coating or treatment may also be on the surface of the substrate that will become the interior of the package. This surface (e.g. the surface generally making up the interior of the package, and optionally treated for good sealing, may be denoted "a" in certain of the Figures herein. This sealing surface "a" is described as the 'heat sealable' surface for ease of description, but not to limit the nature of the sealing surface, which, for example, could be treated by a heat sealable coating, could be treated by a tear-resistant coating or film, or other functional coating, or could be treated by both a heat sealable coating or film and tear resistant coating or film (possibly as a single coating or film), or could be left untreated.

Figure 19B:
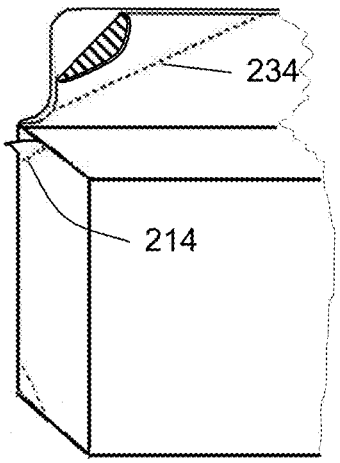
Figure 19C:
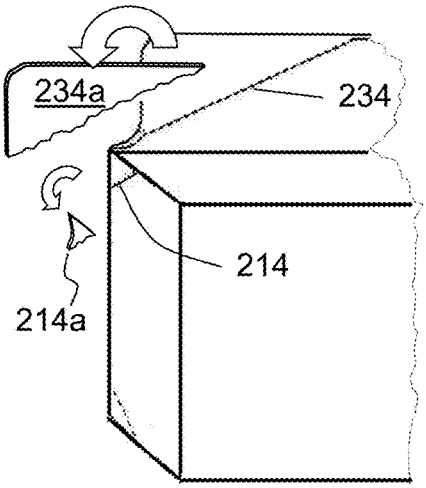

Referring again to FIG. 18, perforated lines 214, extending partly or fully through the panel, may be provided on outer side panels 216 as tear stops to help prevent unauthorized opening or tearing into the package. If the perforations extend only partly through the panel, they may at least extend through a tear resistant coating if one is used. The perforations may be located on the inner (hidden) surface of the side panel 216. The adjacent corners of the outer side panel 216 make contact with corresponding corners of inner side panel 215, whose outer surface is not a heat seal surface "a". Thus it is possible that the sealing here may be incomplete or weaker than at some other points of the package. If the corners of the outer side panels 216 are weakly or incompletely sealed in the final package, it may be possible to pull on these corners and start a tear into the package as shown to the side of the package in FIG. 19B. However, upon reaching the perforated line 214, the corner 214*a* is likely to be torn off as shown in FIG. 19C before the tear can progress further, thus halting the intrusion into the package.

In a similar manner, perforated lines 234, extending partly or fully through the panel, may be provided on panels 229, 239 as tear stops to help prevent unauthorized opening or tearing into the package. If the perforations extend only partly through the panel, they may at least extend through a tear resistant coating if one is used. The perforations may be located on the inner (hidden) surface of panels 229, 239. The adjacent corners of these panels make contact with each other and provide a sealing surface wherein both panels face each other through their respective heat seal surface "a". Thus it is possible that the sealing here may be quite strong. However the corners of panels 229, 239 may still be a point at which an unauthorized user might try to pull the two panels apart and start a tear into the package, as shown an upper corner of the package in FIG. 19B. However, upon reaching the perforated line 234, the corner 234*a* is likely to be torn off as shown in FIG. 19C before the tear can progress further, thus halting the intrusion into the package.

Tear-diverting features such as 114, 214, and 234 may be useful on any corner of any package. They may be particularly advantageous when used at 'terminal' corners, that is, corners on a panel or flap that are not directly hingedly attached to an adjacent other panel. The tear-diverting features 214, 234 shown on FIGS. 18-19 are located at such 'terminal' corners.

The package shown in FIGS. 18-19 has a heat seal coating "a" in advantageous face-to-face contact for panels 229, 239. However, certain other panels (side as the side panels) may lack face-to-face contact of the heat seal coating. The package shown in FIGS. 20-21 is designed to provide a more advantageous configuration of the heat seal surfaces "a."

Figure 20:
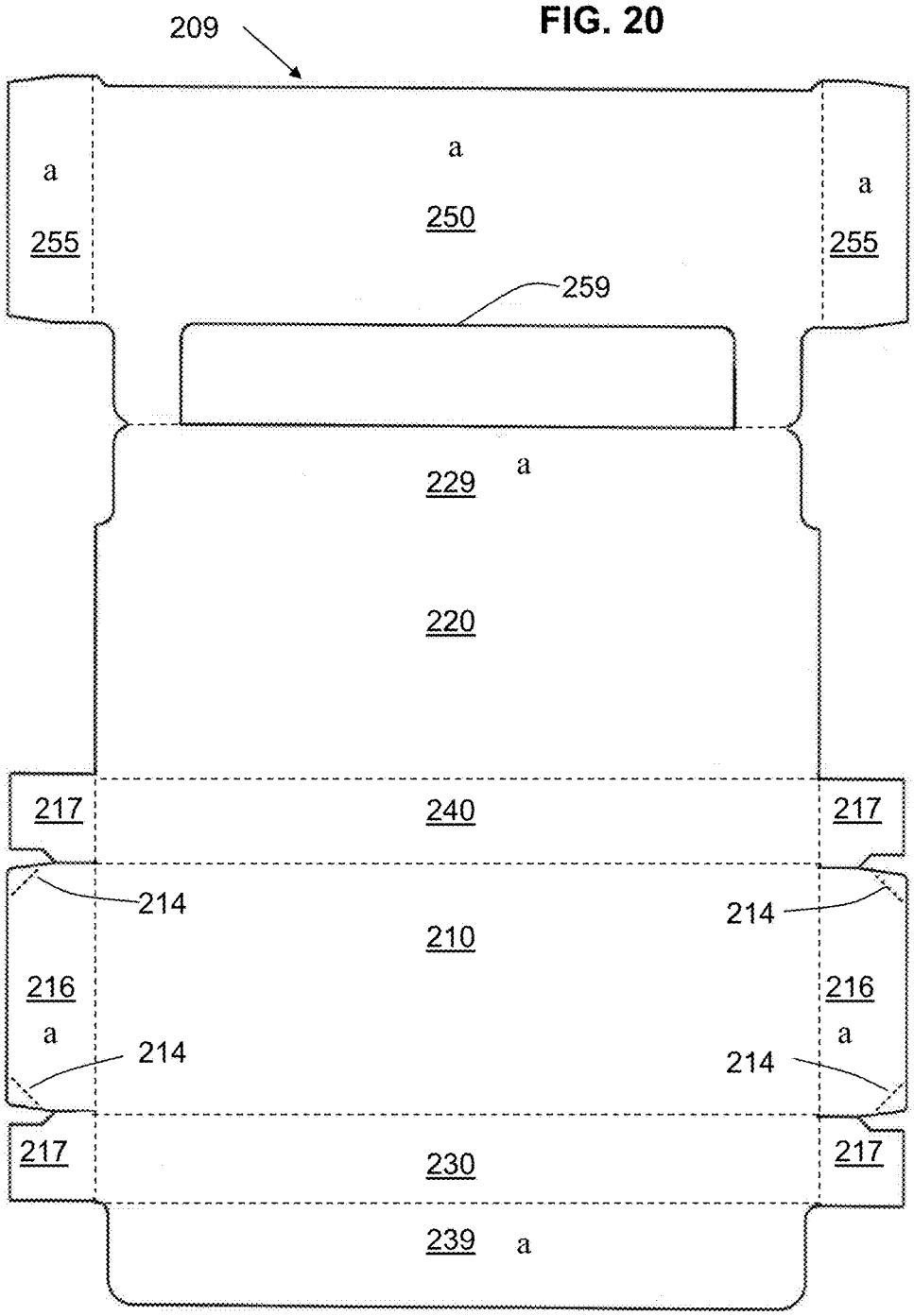
FIG. 20 is a plan view of a blank for making another version of a package.

A blank 209 for making another package is shown in FIG. 20. The blank, and the package created therefrom, are similar in many aspects to the blank and package shown in FIGS. 18-19, and therefore a description of the corresponding features is not needed. Blank 209 however does include an additional internal panel 250 having associated internal side flaps panels and an opening 259 whose purpose will be described. Again the surfaces denoted "a" represent a heat-seal coating which may be on the inside surfaces of the package. Again, as noted for the package shown in FIGS. 18-19, the inside surface may also have a tear-resistant coating or film.

The blank shown in FIG. 20 may be folded as shown in FIG. 21A to form a rectangular tube as shown in FIG. 21B. First, the internal panel 250 may be folded over upon back panel 220 as shown to the upper end of FIG. 21A. This brings together heat sealable coating surfaces "a" of panels 250, 229 for optimal sealing. However a portion of the heat sealable surface of panel 229 is left exposed through opening 259; through opening 259 it is possible to have the heat sealable surfaces "a" of panels 229 and 239 to be in contact and provide optimal sealing.

After internal panel 250 is folded inward, the remaining panels may be folded to form a rectangular tube whose sides are panels 220/250, 250, 210, and 230 respectively. Panels 229, 239 may be sealed together forming an external longitudinal flap as shown in FIG. 21B, with at least part of this sealing being through opening 259 as described in the previous paragraph. Thus good sealing may be achieved between these surfaces despite the presence of the otherwise intervening internal panel 250.

To close the ends of the tube, the side flaps 217 may be folded inward, followed by internal side panel 255. As shown in FIG. 21A, the heat seal coating "a" on internal side panels 255 faces outward, while the heat seal coating "a" on outer side panels 216 faces inward. Thus when the outer side panels 216 are folded inward upon internal side panels 255, they may be advantageously sealed together for a strong bond. Perforation lines 214 may optionally be provided on outer side panels 216 (as shown) or on panels 229, 239 (not shown) or elsewhere on the package.

Detailed descriptions of specific embodiments of the packaging system, blank and outer sleeve for minimizing "pillowing" of the sleeve are next disclosed herein. It will be understood that the disclosed embodiments are merely examples of the way in which certain aspects of the invention can be implemented and do not represent an exhaustive list of all of the ways the invention may be embodied. Indeed, it will be understood that the packaging system, blank and outer sleeve described herein may be embodied in various and alternative forms. The figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 22:
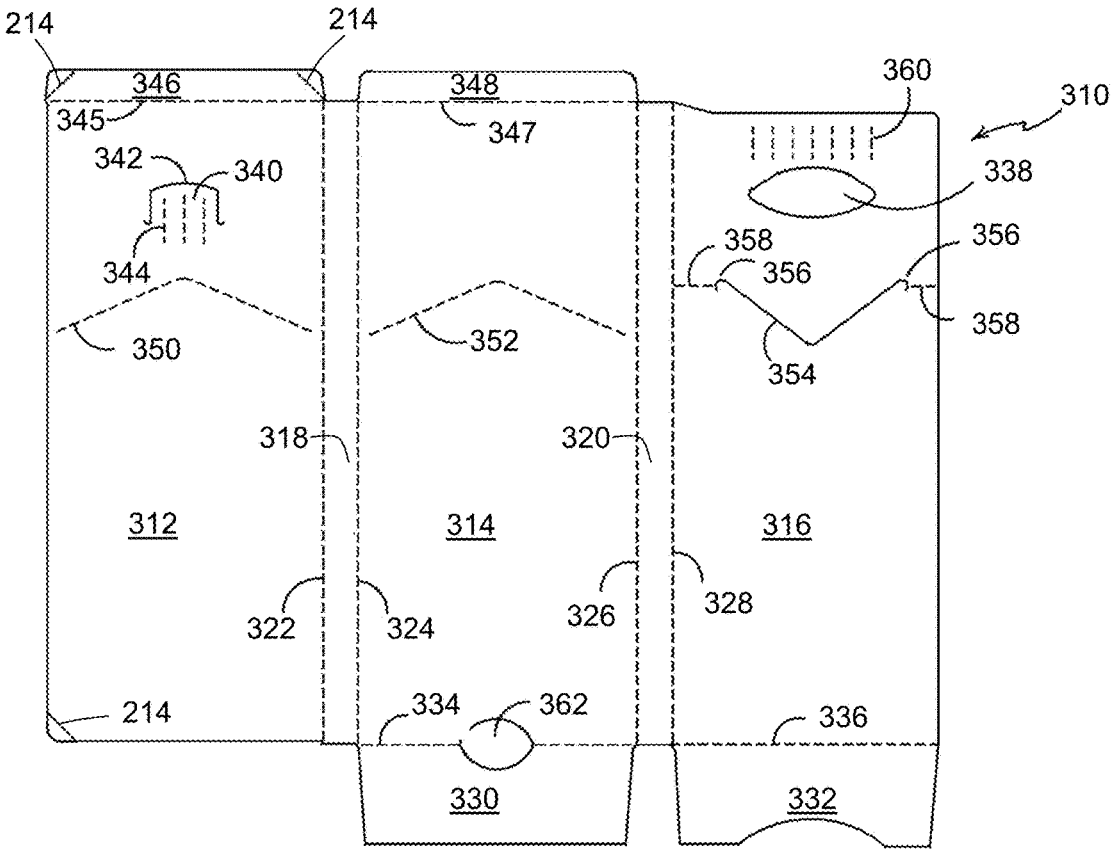
FIG. 22 is a plan view from above of a blank for forming an outer sleeve.
Figure 23:
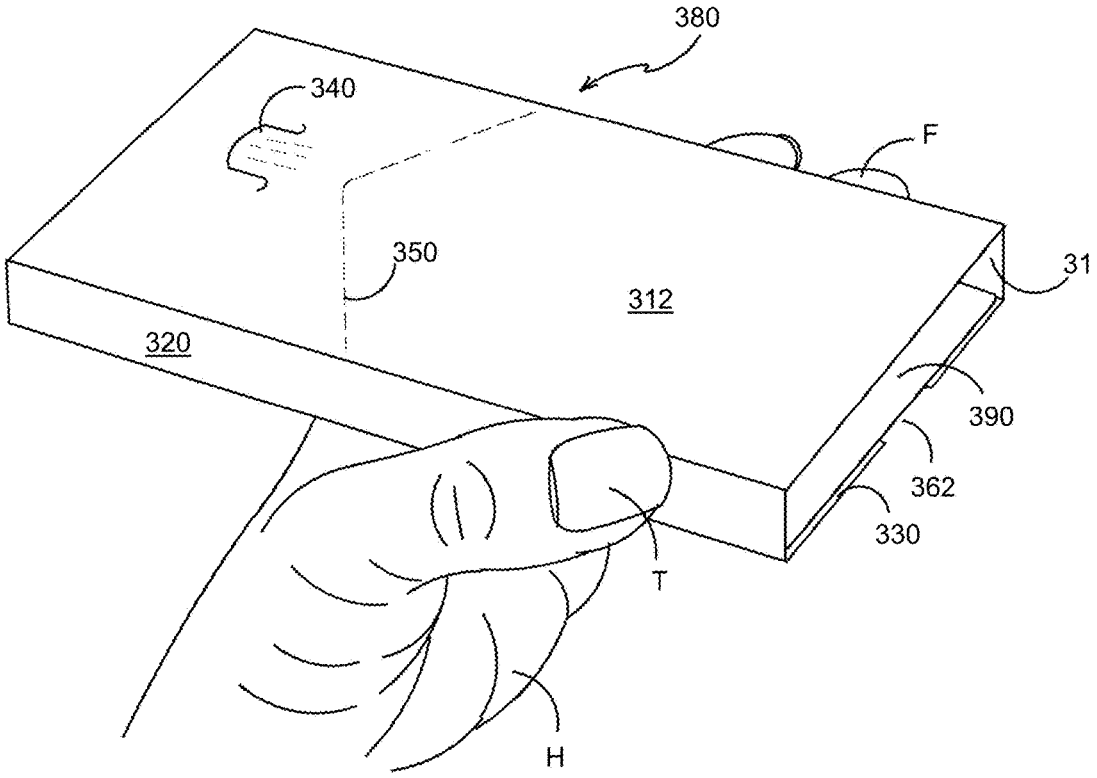
FIG. 23 is a perspective view from the top, side and end of a packaging system comprising an outer sleeve formed from the blank of FIG. 22 and an inner slide card.
Figure 24:
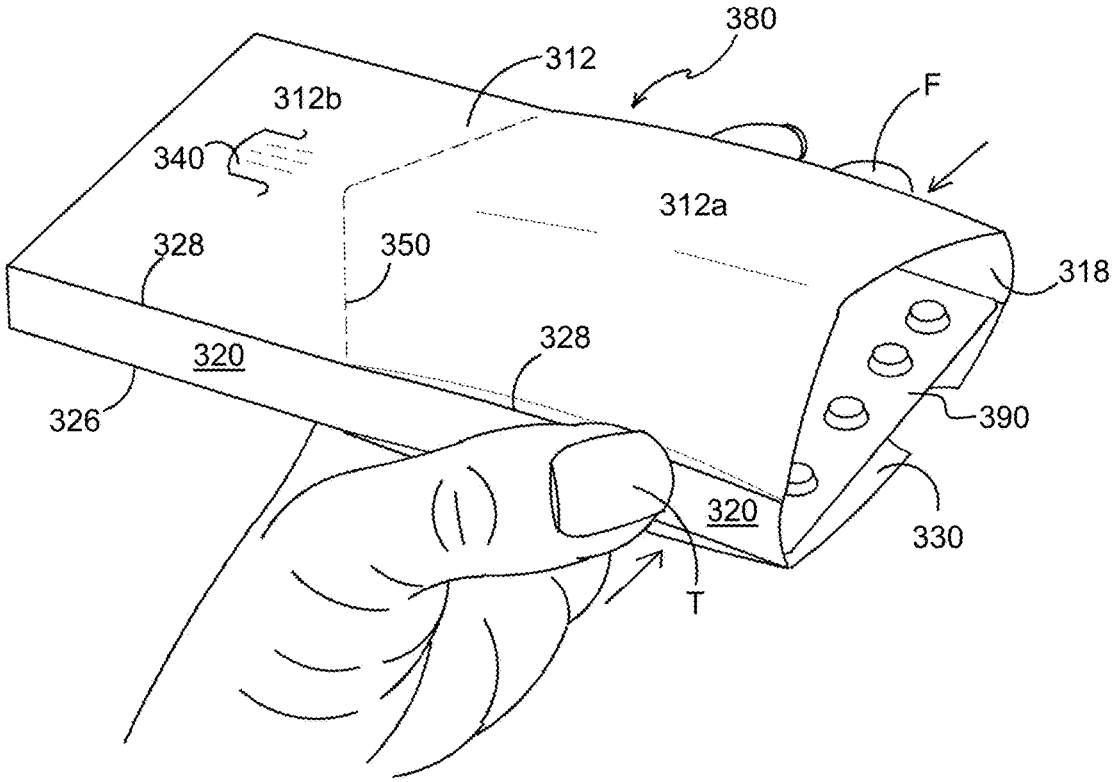
FIG. 24 is a perspective view from the top, side and end of the packaging system of FIG. 23 having its sides squeezed toward one another.

Referring to FIG. 22 there is shown a perspective view of a blank 310 for forming an outer sleeve 380 that is illustrated in FIGS. 23 and 24. The outer sleeve 380 may receive an inner slide card 390 and together the outer sleeve 380 and inner slide card 390 form a packaging system. To form the outer sleeve 380, the blank 310 is provided with a series of structural panels which optionally comprise: an outer top panel 312, a bottom panel 314 and an inner top panel 316. The series of structural panels 312, 314, 316 are linked by first and second side panels 318, 320 which are hingedly connected to the outer top panel 312 and bottom panel 314 and to the bottom panel 314 and an inner top panel 316 respectively, along fold lines 322, 324, 326, 328.

Front end flaps 330, 332 are optionally hinged to the front ends of the bottom panel 314 and inner top panel 316 along fold lines 334, 336. Optionally an inner slide card access 362 is provided along the fold line 334 as an aperture. Once the front end flap 330 is folded over into face contacting relationship with the bottom wall 314 (as is described below with reference to the construction of the outer sleeve 380 from the blank 310), the aperture 362 is formed into a substantially "U"-shaped notch or cut out which exposes a portion of an inner slide card 390 when stowed within the outer sleeve 380. The inner slide card access 362 enables a user of the packaging system to easily grasp a front end of the inner slide card 390 for facilitating withdrawal of the inner slide card 390.

Returning to the blank 310 of FIG. 22, the inner top panel 316 is provided with an engaging edge formed in this arrangement by a locking aperture 338. The inner top panel 316 is also provided with optional embossments, demarcations or ribs 360. The locking aperture 338 is sized, shaped and configured to engage a locking tail flap of an inner slide card 390. Other means may be provided inside of the outer sleeve 380 for lockably engaging an inner slide card 390 to restrict the inner slide card 390 from being withdrawn from the outer sleeve 380.

The outer top panel 312 comprises an unlocking tab 340 sized, structured and configured to overlay or be superimposed above at least a portion of the locking aperture 338. The tab 340 is optionally defined by a cut line 342, which optionally defines a substantially rectangular tab with a curved free edge; and optional demarcations 344 that may advantageously increase the friction between the unlocking tab 340 and a user's finger.

Optionally end closure flaps 346, 348 are hinged to the ends of the outer top panel 312 and bottom panel 314 by fold lines 345, 347. The end closure flaps 346, 348 serve to close the rear end of the outer sleeve 380. The end closure flaps, particularly the outer enclosure flap 346, may have tear-diverting features 214 such as perforations, as described earlier. Likewise outside corners on other panels, such as the lower left corner of front panel 312 as seen in FIG. 22, may have tear-diverting features 214 as well.

It will be understood from the foregoing that the general structure of the outer sleeve 380 may be varied from that described. The shape, size, number and arrangement of panels 312, 318, 314, 320, 316, 330, 332, 346, 348 described and illustrated may be varied and reconfigured and the illustrated and described blank 310 represents one exemplary blank for forming an outer sleeve.

The blank 310 further comprises a mechanism to mitigate against bowing or pillowing of panels that may cause accidental or unintentional disengagement of the inner slide card 390 from the outer sleeve 380. As discussed on page 1 above, when an outer sleeve is squeezed (optionally, proximate its open end), it can "pillow", in other words, the bottom panel and top panel can bow away from one another. This can result in a locking tail flap of an inner slide card 390 (also referred to as a locking foot) being released from engagement with an edge of the locking aperture 338. The present invention provides a mechanism or an arrangement optionally comprising one or more or a combination of: folds, creases, demarcations, embossments, scores and half-depth cuts, configured and arranged to prevent or limit "pillowing" or bowing of at least the inner top panel 316, in the region of the locking aperture 338. Preferably, but nevertheless optionally, the arrangement may comprise one or more or a combination of: folds, creases, demarcations, embossments, scores and half-depth cuts, configured and arranged to prevent or limit "pillowing" or bowing (in the region of the locking aperture 338) of the inner top panel 316, outer top panel 312 and the bottom panel 314.

An optional arrangement is illustrated in FIG. 22, the inner top panel 316 comprises a line of separation 354, which in the illustrated arrangement takes the form of a "V"-shaped cut line 354 optionally having sharply curved terminations 356 (provided to mitigate against the cut 356 extending further into the inner top panel 316 and side panels 318, 320). As such the line of separation 354 preferably terminates within the inner top panel 316 and optionally does not dissect the inner top panel 316, though in other embodiments it may dissect the inner top panel 316. The line of separation 354 is linked to the side edges of the inner top panel 316 by folds 358 that may be substantially linear in shape. Optionally, the linear folds 358 may be omitted or alternatively arranged, for example at an angle relative to the edge of the inner top panel 316.

Preferably, but nevertheless optionally, the bottom panel 314 and outer top panel 312 and each comprise a line of demarcation 350, 352. In the illustrated, optional embodiment, the lines of demarcation 350, 352 are each formed as a "A"-shaped crease or fold lines 350, 352 (also referred to as substantially inverted "V"-shaped). The lines of demarcation 350, 352 are optionally directed oppositely to the "V"-shaped cut line 354. The lines of demarcation 350, 352 are sized and arranged to be vertically aligned with one another and to be substantially vertically aligned or to be at least partially superimposed over the "V"-shaped cut line 354 in the inner top panel 316. The line of separation 354 and the or each line of demarcation 350, 352 delineate two notional regions of the panel (the inner top panel 316, outer top panel 312 and bottom panel 314) in which they are formed. These regions or areas are generally denoted by references 312*a* and 312*b* in FIG. 24. The first of these regions 312*b*, in the proximity of the engaging aperture 338 is restricted from being bowed when a force is applied by a user to squeeze the first and second sides 318, 320 together. The second of these regions 312*a* proximate the front end of the outer shell 380 may still bow when a force is applied by a user as illustrated in FIG. 24.

Turning to the construction of the outer sleeve 380 as illustrated in FIGS. 23 and 24 it is envisaged that the outer sleeve 380 can be formed by a series of sequential folding operations in a straight line machine so that the carton is not required to be rotated or inverted to complete its construction. The folding process is not limited to that described below and may be altered according to particular manufacturing requirements.

The front end flaps 330, 332 may be folded about fold lines 334, 36 into face contacting relationship with the inside faces of the adjacent bottom and inner top panels 314, 316 respectively and optionally glued or otherwise affixed thereto. By folding about fold lines 326 and 328, the inner top panel 316 may be brought into superposition with the bottom panel 314. By folding about fold lines 324 and 322, the outer top panel 312 may then be brought into superposition or overlaying contact with the inner top panel 316. Portions of the upper face of the inner top panel 316 and/or portions of the lower face of the outer top panel 312 may be applied with adhesive to selectively attach the two top panels 312, 316 together. The region of the unlocking tab 340 is not glued to enable the movement of the unlocking tab 340. End closure flaps 346, 348 may be folded about fold lines 345 and 347. Glue adhesive or other affixing means may be used to attach the end closure flaps 345, 347 together to thereby close the rear end of the outer sleeve and to assist in maintaining the outer sleeve 380 in a constructed form.

In use, an inner slide card optionally such as inner slide card 390 illustrated in FIGS. 23 and 24 which holds articles (for example medication in the form of capsules, tablets, and caplets, but optionally any other article) within blisters mounted on a card may be used in-conjunction with the outer sleeve 380 to form a packaging system. The inner slide card 390 preferably has an engaging element (not illustrated), optionally a locking tail flap or locking foot at its rear-end for catching an engaging edge 338 (optionally provided by the locking aperture) and for locking the inner slide card 390 within the outer sleeve 380. Depression of the unlocking tab 340, which is superimposed above the region of the inner top panel 316 comprising the locking aperture 338, can cause disengagement of the engaging element of the inner slide card 390, which can then be released, by withdrawal from the outer sleeve 380. The free edge of the folded end flap 332 provides another edge against which the engaging element, (for example locking tail flap or locking foot) of the inner slide card 390 can catch onto or engage thus to prevent complete withdrawal of the inner slide card 390 from the outer sleeve 380.

Once the outer sleeve 380 is fully constructed, if the first and second side panels 318, 320 of the package are squeezed together, for example between a user's fingers F and thumb T) (see FIG. 24), then the mechanism to mitigate against accidental or unintentional disengagement of the inner slide card 390 from the outer sleeve 380 will sufficiently counteract the effect of the squeezing (also referred to as a compressive force) in the first region 312*b* proximate the locking aperture 338. As such, whereas part of the outer sleeve 380, near the open front end may still significantly pillow (in other words a second region 312*a* of the inner top and outer top 312, 316 and bottom walls 314 may bow away from one another), the part of the outer sleeve, in the first region 312*b* of the locking aperture 338 (which is denoted generally by reference 312*b*) will preferably not pillow at all or optionally, will only pillow or bow a small amount and within a tolerance that is not sufficient to cause the inadvertent disengagement of the inner slide card 390 from the outer sleeve 380.

In particular the line of separation 354 or "V"-shaped cut 354 and optionally the lines of demarcation 350, 352 or "^"-shaped crease lines 350, 352 (which may optionally be disposed on the outer surface and/or the inner surface of the bottom and outer top panels 314, 312) limit pillowing or bowing of the inner top/outer top 312/16 and bottom walls 314 in the region of the locking aperture 338.

Optionally demarcation lines or ribs 360 may be provided to increase the stiffness of the inner top panel 316 in the region of the locking aperture 338.

Optionally, the unlocking tab 340 may be oriented as shown which is substantially a 90° rotation compared to the orientation of known unlocking tabs 340. This is to direct the displaceable tab 340 toward the rear end of the outer sleeve 380 which may promote a more exact button push (in other words may require a more accurate and deliberate press of the unlocking tab 340) to disengage the engaging element of the inner slide card 390 to release the inner slide card 390.

It can be appreciated that various changes may be made within the scope of the present invention, for example, the size and shape of the panels and apertures may be adjusted to accommodate articles of differing size or shape. In other embodiments of the invention it is envisaged that the line of separation 354 may be replaced by a cut of different but suitable size and shape. Further optionally, it is envisaged that the line of separation or "V"-shaped cut 354 may be first formed by a frangible or other perforable connection, which may be deliberately broken after manufacture of the outer shell 380 is complete, or which may be broken by the act of the side walls being forced toward one another. Preferably, however, separation of the inner top panel 316 into two notional parts (a region 312*a* that may bow and a region 312*b* that preferably does not bow in response to the side walls 318, 320 being forced toward one another) is achieved by a cut that extends preferably only partially across the inner top panel 316. Whereas a "V"-shaped line of separation 354 is suitable for mitigating the bowing of the inner top panel 316 past the point of that line of separation 354, it will be understood that other shapes and configurations for the line of separation may be suitable. In other embodiments it is optionally envisaged that the line of separation 354 may not be "V"-shaped, but may for example be curvilinear, arcuate, "W"-shaped, a rounded "U" shape, non-symmetrical, tapered and/or irregular, for example a saw-toothed-lined "V"-shape.

Similarly, it is envisaged that the lines of demarcation 350, 352 may take many and various, shapes, sizes, positions and angular arrangements. It is optional that the lines of demarcation 350, 352 are similar in size and shape and it is envisaged that in other embodiments the lines of demarcation 350, 352 may each be differently shaped, differently angled and differently positioned. It is however preferred that the lines of demarcation 350, 352 point or diverge toward the rear end of the outer shell 380 and/or point or diverge in the opposite direction to the direction in which the line of separation 354 points toward.

It is envisaged that the angle of the line of separation 354 and the angle of the lines of demarcation 350, 352 may be the same, may all be different may be partly the same and partly different.

Preferably, the line of separation 354 is formed as a continuous line, this is so that when the outer shell 380 is squeezed and pillowed, the "V"-shaped cut line 354 lays flat so that the inner card 390 remains in the locked position, however in other optional envisaged embodiments a non-continuous line of partial separation may mitigate some bowing that may be suitable and sufficient in this and other packaging applications.

It will be recognized that whereas a mechanism for mitigating against bowing or pillowing is advantageously employed in a packaging application where the pillowing can lead to inadvertent unlocking of a child-proofing lock, that the mechanism for mitigating against bowing or pillowing may advantageously be employed in a variety of other packaging applications. As such, whereas the mechanism for mitigating against bowing or pillowing has been described and illustrated in the context of a child-proof packaging system comprising an outer sleeve and a lockable inner slide card, it will be understood that protection for the invention is not limited to that specific application and it is envisaged that the mechanism for mitigating against bowing or pillowing may be advantageously employed in other suitable packaging applications.

It is envisaged that the stiffening ribs 360 may be oriented differently to that shown and yet still provide an advantageous stiffening of the inner top panel 316 in the region of the locking aperture 338. For example, the stiffening ribs 360 may optionally be oriented: vertically, horizontally and/or diagonally. Preferably, but nevertheless optionally, the ribs 360 are disposed behind the locking aperture 338. In other embodiments of the invention, the ribs 360 are disposed in the region of the unlocking aperture 338 and/or on the outer top panel 312 or bottom panel 314 and in any other suitable arrangement.

It will be realized that if a substantial enough force is applied, (by a mechanical vice for example) that ultimately, the first region 312*b* could bow or pillow, however, it will also be understood that the invention provides a benefit in the normal use of a package where it has been found that child proofing mechanisms can sometimes be inadvertently overcome by a child squeezing the mouth or front end of an outer shell and that the bowing of the panels that results can result in failure of the locking mechanism. As such, where compressive or squeezing forces are referred to, it is the forces that a typical user could apply by squeezing the package, with their hand.

FIG. 25A shows another perspective view of the package in its "pillowed" form, and showing how line of demarcation 350 helps arrest the pillowing action and keep the closed end of the sleeve in a relatively undisturbed shape. FIG. 25B shows a similar cutaway view.

FIG. 25C shows a cross section detail view of the locking mechanism and the anti-pillowing features. Blisters 392 are shown along with an optional longitudinal stiffening rib 393 (additional longitudinal or cross-ways ribs may be used). Locking component 395 of the blister card 390 engages locking aperture 338 of the sleeve. Despite the pillowing of the open end of the sleeve, the lines of demarcation 350, 352 and the line of separation 354 arrest the deformation of the sleeve and maintain the closed end of the sleeve to retain its intended shape, holding the locking component 395 securely in locking aperture 338, until such time that an authorized user activates unlocking tab 340 to release the blister card.

FIGS. 26A and 26B show top and bottom perspective views of another blister card 420 that may have on its upper or first surface 424 multiple blisters 422, one or more longitudinal stiffener ribs 428, and one or more crossways stiffener ribs 426. The upper surface 424 may be a formed plastic of PVC or similar material. The opposite or lower surface 425 may be relatively smooth and may be a lidding material such as a metal foil or other foil or paper, for sealing the blisters 422. The blister card 420 may include a tail portion 440 hingedly attached to the blister card 420 along a fold line 446. The tail portion 440 may be made of the same upper and lower materials as the blister card 420. For example the lidding material may extend from the lower surface 425 across fold line 446 and on the lower surface 447 of tail portion 440.

Formed or cut into the fold line 446 may be one or more locking components 444 such as arcs or similar shapes which may protrude away from the lower surface 425. One or more stabilizer peaks 445 may be formed in tail portion 440. Adjacent to stabilizer peaks 445 may be formed additional stiffener ribs 443.

FIG. 26C shows the blister card 420 (inverted as in FIG. 26B) now contained within a sleeve, with certain sleeve panels denoted as bottom panel 314 and inner top panel 316. Locking components 444 of the blister card 420 may engage locking aperture 338 of the sleeve. The stabilizer peaks 445 may serve to prevent the tail 440 from being folded too greatly relative to the blister card.

Figure 27A:
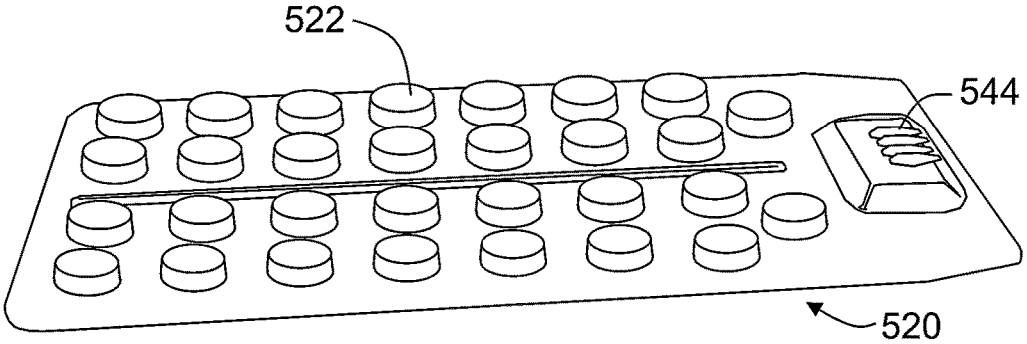
FIGS. 27A-27B are perspective views of another blister card.
Figure 27B:
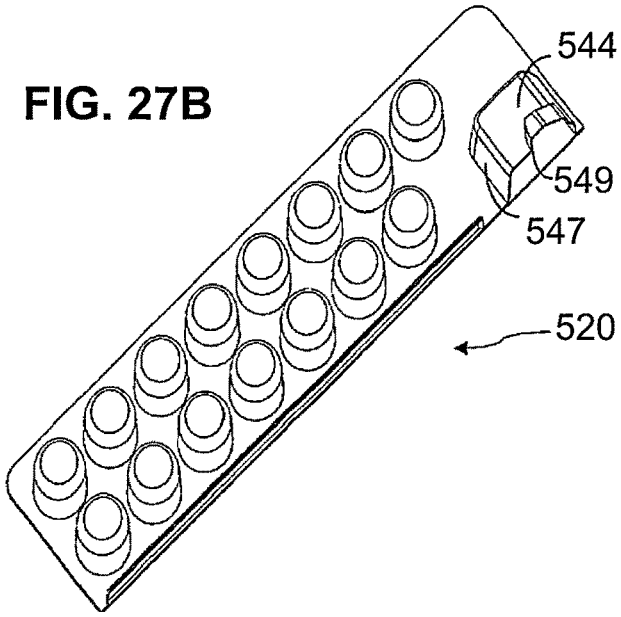

FIGS. 27A and 27B show top perspective views of another blister card 520 with multiple blisters 522. Instead of a folded tail, the blister card 520 may have a formed feature 544, for example formed in the blister layer of the blister card 520 and having one or more walls 547 which are raised above the plane of the blister card. A portion of the formed feature 544 may be an engagement edge 549 provided to engage a sleeve locking aperture 338. The engagement edge 549 may be constructed similarly to the edge shown in FIGS. 28A-28B.

Figure 28A:
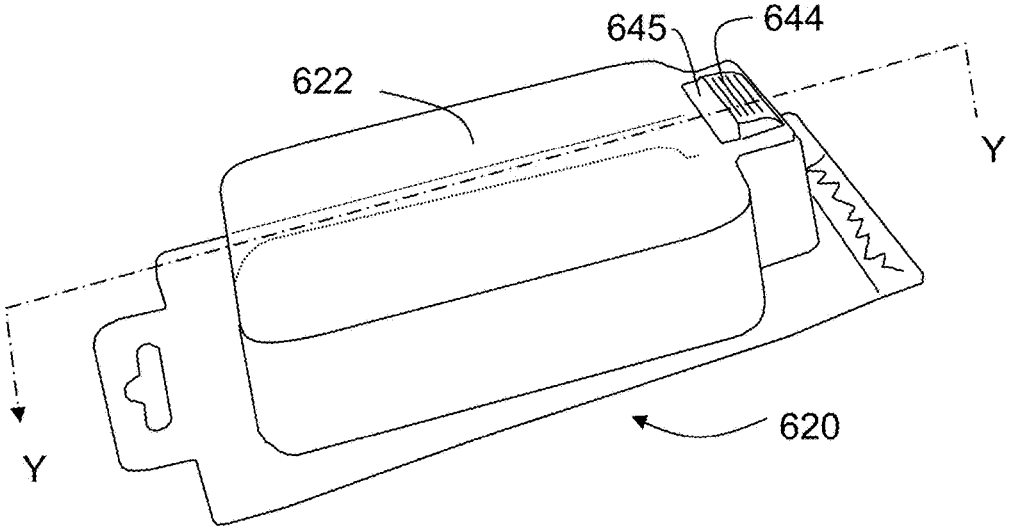
FIGS. 28A-28C are perspective and cross section views of another blister card having a single cavity.
Figure 28B:
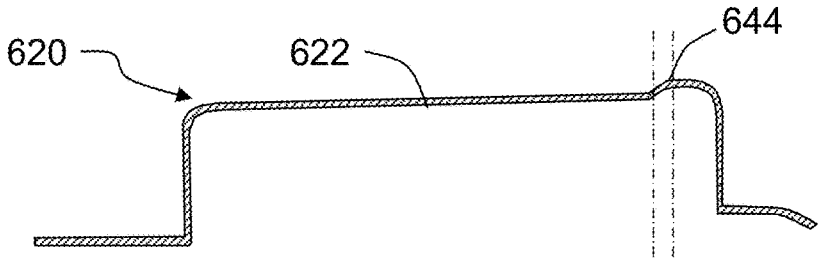
Figure 28C:
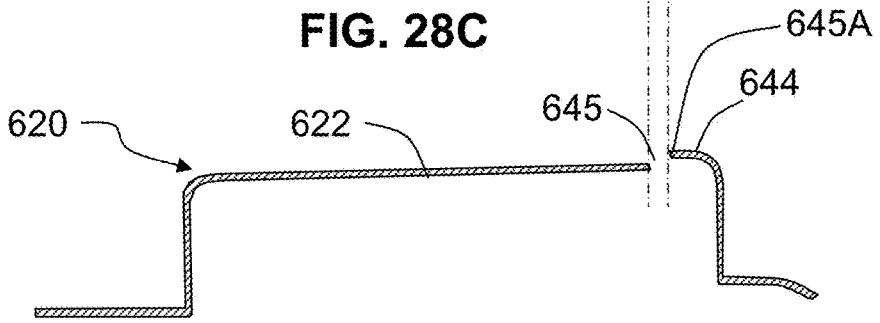

FIG. 28A shows a top perspective view of another blister card 620 having only a single cavity 622. Again instead of a folded tail, the blister card 620 may have a formed engagement feature 644, 645. This engagement feature may be formed in body of the single cavity 622, or separate therefrom. A cross section along line Y-Y is shown in FIG. 28B. If the cavity is formed by certain molding operations such as vacuum forming, it may be difficult to get a sharp edge on engagement feature 644. Although engagement feature 644 still may engage sleeve locking aperture 338, a somewhat more aggressive engagement may be obtained if, as shown in FIG. 28C, a slit or slot 645 in cut or otherwise formed into feature 644. For example this may be achieved by making one or more cuts into the cavity wall. As shown in FIG. 28C, two slits or cuts made at different elevations can remove a thin section of material and leave a rather sharp edge 645A that is able to rather strongly engaged sleeve locking aperture 338. The edge 645A may be at a higher elevation (e.g. a raised edge) relative to the cavity wall 622 on the other side of slit or slot 645. The raised edge may provide a stronger engagement with a sleeve locking aperture 338.

Figure 29:
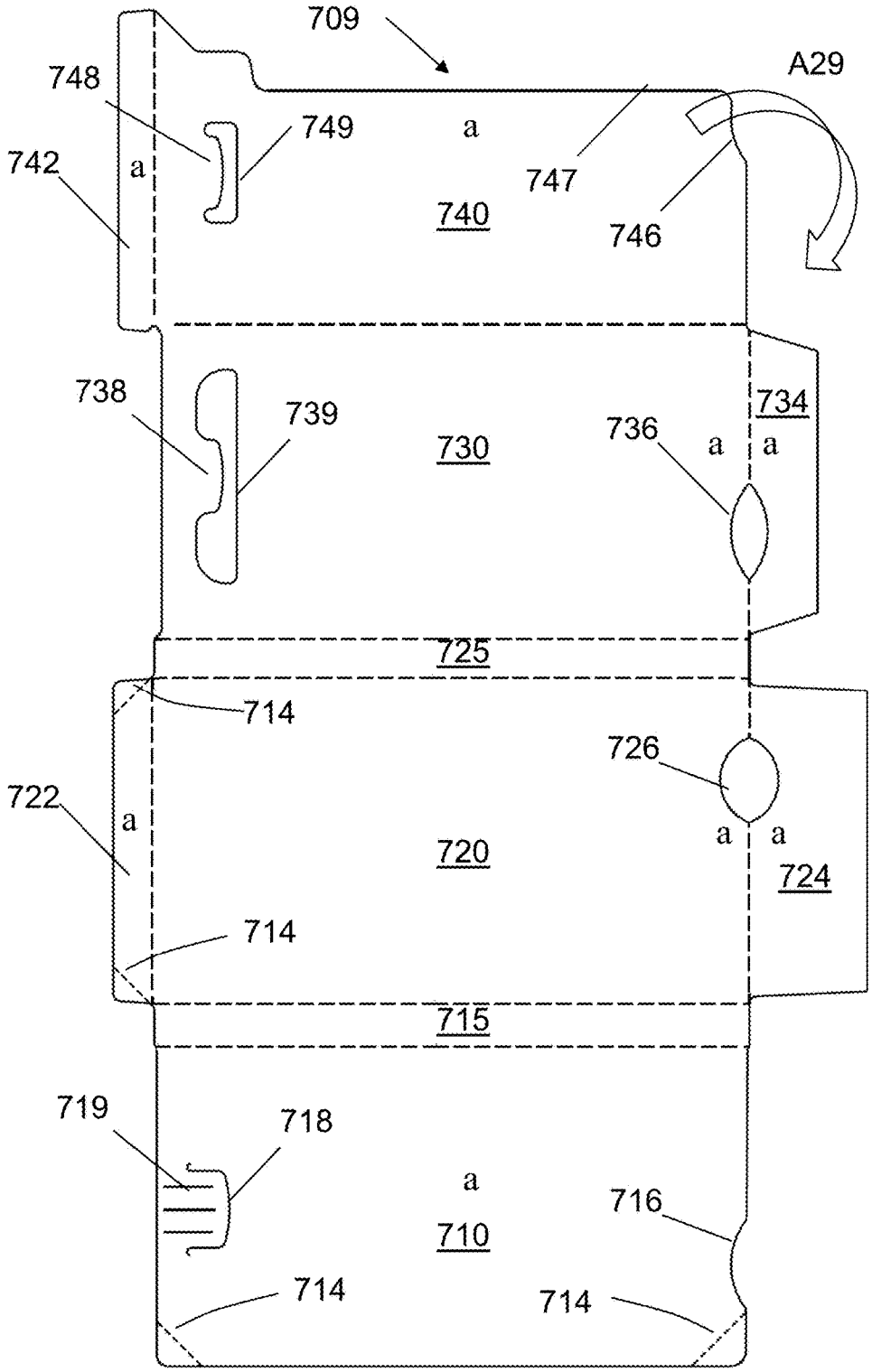
FIG. 29 is a plan view of a blank for making yet another version of a package.

Next will be described another package sleeve particularly adapted for strongly sealing the end flaps. In FIG. 29 is shown a blank 709 for making sleeve 700. In this example the sleeve forms a generally tubular structure with a rectangular cross section. Generally the longitudinal walls of such a sleeve would be include five sections, such as four panels connected in series, with at least fifth panel or flap (such as a glue flap) extending from the fourth panel to attach onto the first panel. Blank 209 includes six panels to form the tubular structure, which gives certain advantages in obtaining strong sealing, particularly on the end flaps.

As shown in FIG. 29, blank 709 has a series of foldably attached panels including front panel 710, first side panel 715, back panel 720, second side panel 725, first auxiliary panel 730, and second auxiliary panel 740.

Front panel 710 may include a release button in the form of an area denoted by a cutline 718 which be generally U-shaped. The release button may have score lines 719 to provide stiffness. A cutaway 716 may be provided which may coincide with other cutaways in the finished sleeve 700. Corners of the front panel 710 may include perforations 714 that may be useful as tear-diverting features.

Back panel 720 at one end may be hingedly attached to a first or outer end closure flap 722, whose corners may also be provided with perforations 714. Back panel 720 at its opposite end may be provided with an inward facing flap 724 that may be useful for retaining contents within the sleeve. A cutaway 726 may be provided which may coincide with other cutaways in the finished sleeve 700.

The first auxiliary panel 730 at one end may have an aperture 739 shaped to engage a catch feature (not shown) on a content item such as a blister card. Release tongue 738 may extend into the aperture 739 to act along with release button 718 and release tongue 748. At the other end of the first auxiliary panel 730 may be provided an inward facing flap 734 that may be useful for retaining contents within the sleeve. A cutaway 736 may be provided which may coincide with other cutaways in the finished sleeve 700.

The second auxiliary panel 740 at one end may have an aperture 749 shaped to engage a catch feature (not shown) on a content item such as a blister card. Release tongue 748 may extend into the aperture 749 to act along with release button 718 and release tongue 738. For example the release button 718, release tongue 738, and release tongue 748 may all deflect inward when a user applies inward pressure to the release button 718. Second auxiliary panel 740 at this end may be hingedly attached to a second or inner end closure flap 742. At the opposite end, cutaway 746 may be provided which may coincide with other cutaways in the finished sleeve 700. The distal long end of the second auxiliary panel 740 may be partially cut away as shown by cutaway 747.

In the blank 709 as shown in FIG. 29, the upward-facing surfaces are denoted "a" to represent a heat-seal coating which may be located generally on the inside surfaces of the finished sleeve 700. The opposite surface of the blank may have a surface adapted particularly for printing, and may be located generally on the outside of the finished sleeve 700.

The blank shown in FIG. 29 may be folded as denoted by arrow A29 with the second auxiliary panel 740 folded backward and behind the first auxiliary panel 730. The auxiliary panels 730, 740 may be attached together for example by glue or hot melt glue. The adjoining surfaces in this case may not have the heat seal coating "a". This results in the configuration shown in FIG. 30, where the now hidden second auxiliary panel 740 is denoted by phantom lines. The cutaways 736, 746 are seen to coincide along the edge of the structure. Also release tongues 738, 748 generally overlap in this configuration.

The inward facing flaps 724, 734 may now be folded inward upon back panel 720 and first auxiliary panel 730, respectively. These flaps may be held in place by the creased fold, or may be glued against their respective panels, or heat sealed thereto (since the inward surfaces have the heat seal coating "a.")

Figure 30:
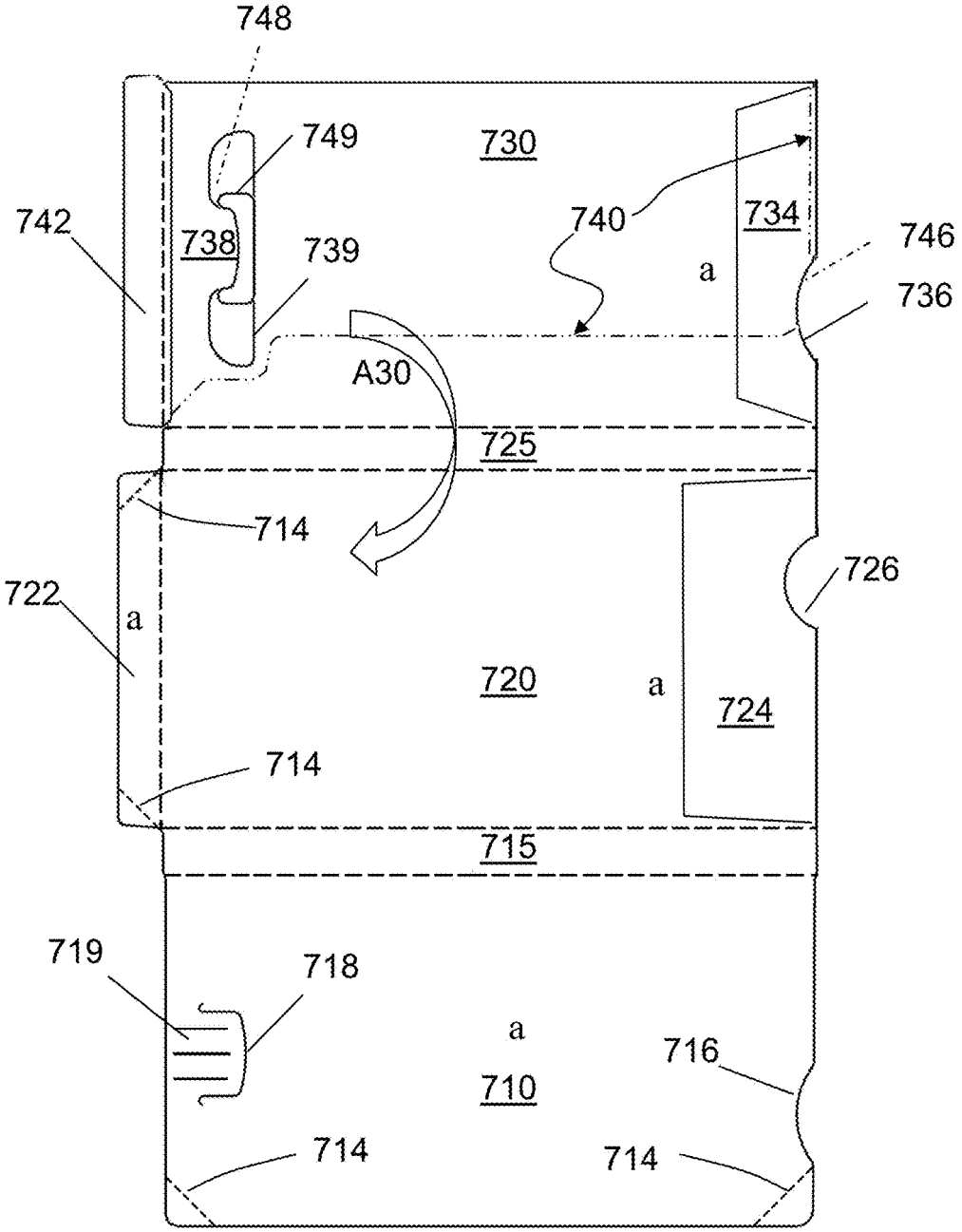
FIG. 30 is a plan view of the package made from the blank of FIG. 29 during a stage of its assembly.
Figure 31:
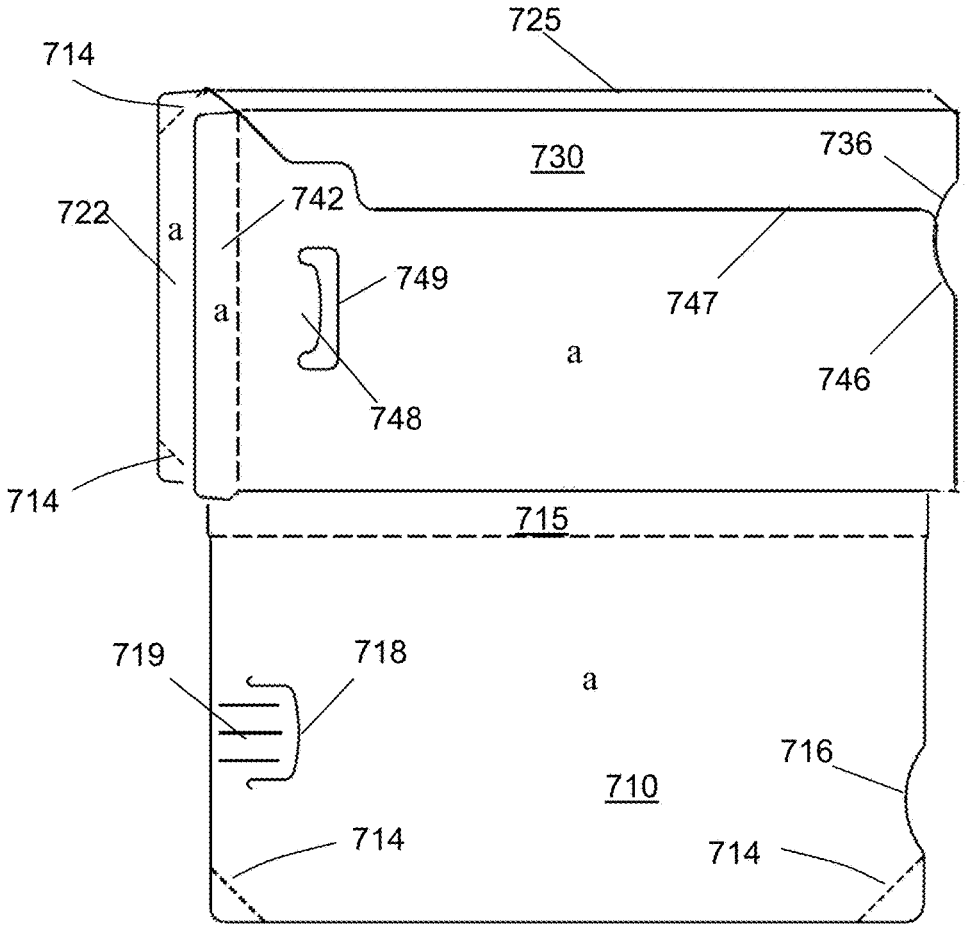
FIGS. 31 and 32A are perspective views of the package during additional stages of its assembly.

The structure shown in FIG. 30 may be folded as denoted by arrow A30 with the auxiliary panels 730, 740 folded forward and over back panel 720. This results in the configuration shown in FIG. 31, where the back panel 720, second side panel 725, and auxiliary panels 730, 740 make up three walls of a tubular structure. The first or outer closure flap 722 on its upper surface has heat seal coating "a". Likewise the second or inner closure flap 742 on its upper surface has heat seal coating "a". Alternately, other forms of adhesive may be used to seal these portions together. It should be noted that the use of tear resistant materials, and/or more than one layer, help to improve the tamper- and theft-resistance of the package. For example such a coating or treatment may also be on the surface of the substrate that will become the interior of the package. Alternately the inside surface may be left untreated, which might still provide a better sealing surface than some coated surfaces, for example those with coatings optimized for printing, or glossy coatings. This sealing surface "a" is described as the 'heat sealable' surface for ease of description, but not to limit the nature of the sealing surface, which, for example, could be treated by a heat sealable coating, could be treated by a tear-resistant coating or film, or other functional coating, or could be treated by both a heat sealable coating or film and tear resistant coating or film (possibly as a single coating or film), or could be left untreated.

Figure 32A:
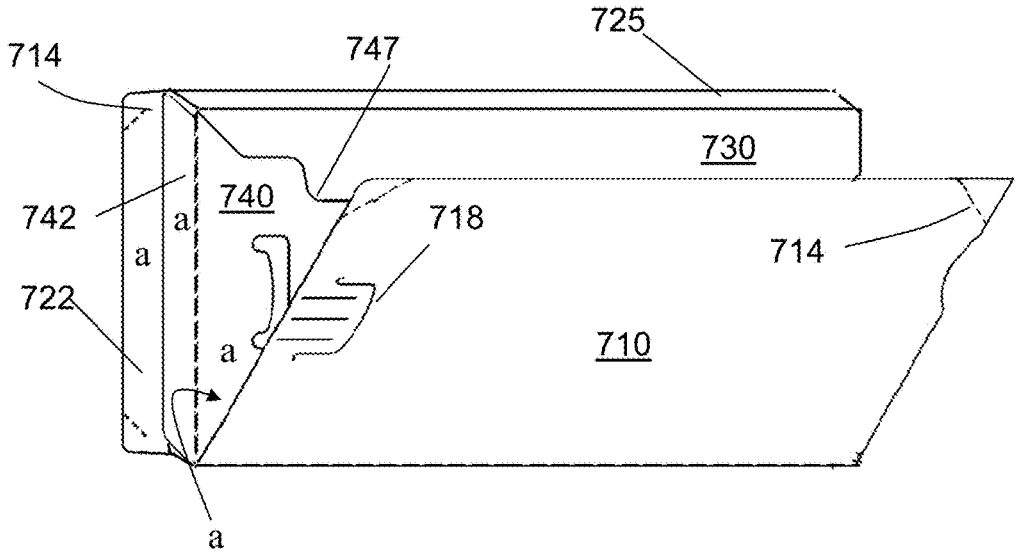
Figure 32B:
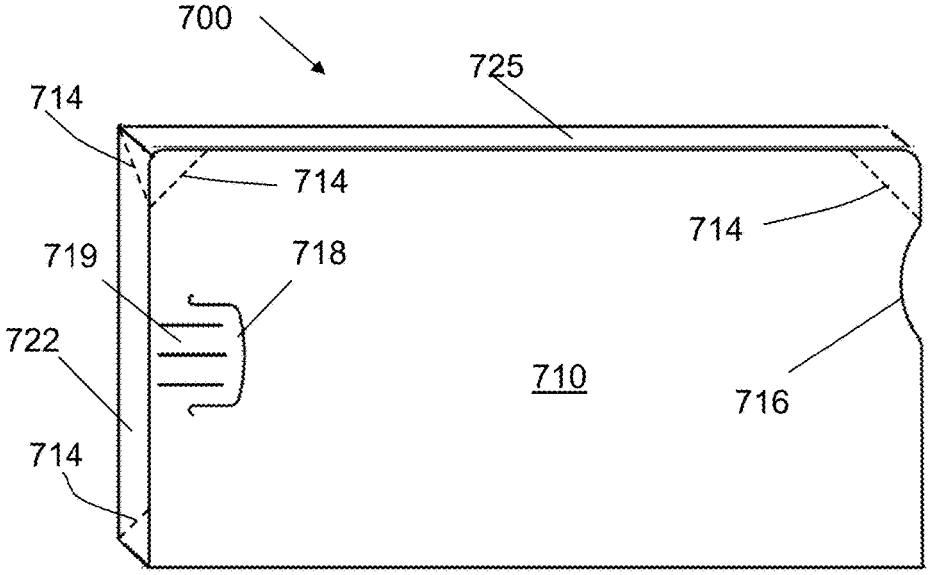
FIG. 32B is a perspective view of the assembled package.

To finish assembling the sleeve, as shown in FIG. 32A, the inner closure flap 742 is first folded downward. The heat seal coating on this flap according faces outward (to the left on FIG. 32A). The outer closure flap 722 may then be folded upward into facing contact with the inner closure flap 742. The facing surfaces are both heat seal coated so that a very strong seal may be created on the flap. As seen on FIG. 32B, the outer closure flap 722 has two exposed corners which a child may attempt to peel in order to gain access into the sleeve. However, if the corners begin to peel, the perforations 714 will tear and stop the peeling, and at least delay access by this route.

As shown in FIG. 32A, the outward facing surface of second auxiliary panel 740 has the heat seal coating "a", as does the inward facing surface of front panel 710. After the front panel 710 has been folded up and over secondary auxiliary panel 740, these two panels may be heat sealed together giving the finished sleeve seen in FIG. 32B. Since both facing surfaces have the heat seal coating, a very strong seal may be obtained.

Cutaway 747 in second auxiliary panel 740 allows a portion of the inner surface of front panel 710 (a surface having the heat seal coating) to seal to a portion of the surface of the first auxiliary panel 730 (a surface that may not have the heat seal coating).

The exposed corners of the front panel 710 provide sites which a child may attempt to peel open the package. The perforations 714 provided near these corners will halt a peeling tear, preventing or delaying entry into the package by this route.

As the front panel 710 is secured to both auxiliary panels 730, 740, the front panel in effect has three plies. This stiffens the front panel, which may help prevent the bowing addressed by the structures shown in FIGS. 22-25. The auxiliary panels 730, 740 may be used with features shown in FIGS. 22-25, including for example the lines of demarcation and the lines of separation.

It will be recognized that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

Sealing of the packages may be done by heat sealing, gluing, a combination of heat sealing and gluing, or other method. Heat sealing may be accomplished by use of both heat and pressure. If a heat sealable coating is used, hot melt glue may be applied to activate the heat seal coating and/or to help with sealing. It is to be understood that alternate sealing methods may be utilized depending upon manufacturing preferences.

The packages disclosed herein may be made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

It is to be understood that certain packages may be one continuous piece of material, and other packages may comprise two or more pieces of material. It is to be understood that a package may be heat sealed even where a heat sealed surface is in contact with a non-heat sealable surface. It is to be understood that in such a situation such an adhesion will strengthen the package, though it may not strengthen it as much as heat sealing between two heat sealable surfaces.

The invention claimed is:

1. A package made from sheet material, the package comprising;

a first panel on an external face of the package, the first panel having an outer surface and an inner surface, and bounded by at least one first outer corner;

a second panel adhesively attached to the first panel inner surface including an inner surface of the first outer corner; and a perforation or line of weakness formed in the first panel proximate to the first outer corner and not extending from said first panel onto any adjacent panel;

wherein the first panel includes a first portion between the corner and the perforation or line of weakness and a second portion on the other side of the perforation or line of weakness, and upon removal of the first portion, the second portion remains adhesively attached to the second panel;

wherein the package further comprises a plurality of longitudinally extending panels and at least one closed end, the closed end being at least partly formed by the first panel;

wherein the first outer corner is not directly hingedly connected to any one of the longitudinally extending panels.

2. The package of claim 1, wherein the perforation or line of weakness extends partially through the first panel.

3. The package of claim 1, wherein the perforation or line of weakness extends into the first panel inner surface.

4. The package of claim 1, wherein the second panel is adhesively attached to the first panel using a heat-seal coating.

5. The package of claim 1, wherein the sheet material is tear-resistant paperboard.

6. A package made from sheet material, the package comprising;

a first panel on an external face of the package, the first panel having an outer surface and an inner surface, and bounded by at least one first outer corner;

a second panel adhesively attached to the first panel inner surface including an inner surface of the first outer corner; and a perforation or line of weakness formed in the first panel proximate to the first outer corner and not extending from said first panel onto any adjacent panel;

wherein the first panel includes a first portion between the corner and the perforation or line of weakness and a second portion on the other side of the perforation or line of weakness, and upon removal of the first portion, the second portion remains adhesively attached to the second panel;

wherein the package is in the form of a tubular structure comprising a plurality of longitudinally extending panels;

wherein the first panel is one of said longitudinally extending panels;

wherein the first outer corner is not directly hingedly connected to another of said longitudinally extending panels.

7. A package made from sheet material, the package comprising;

a first panel on an external face of the package, the first panel having an outer surface and an inner surface, a first free edge and a second free edge intersecting the first free edge at a corner;

a second panel adhesively attached to the first panel inner surface including an inner surface of the corner; and a perforation or line of weakness formed in the first panel proximate to the corner and extending from the first free edge to the second free edge;

wherein the first panel includes a first portion between the corner and the perforation or line of weakness and a second portion on the other side of the perforation or line of weakness, and upon removal of the first portion, the second portion remains adhesively attached to the second panel;

wherein the package is in the form of a tubular structure comprising a plurality of longitudinally extending panels;

wherein the first panel is one of said longitudinally extending panels;

wherein the first outer corner is not directly hingedly connected to another of said longitudinally extending panels.

8. The package of claim 7, wherein the perforation or line of weakness extends partially through the first panel.

9. The package of claim 7, wherein the perforation or line of weakness extends into the first panel inner surface.

10. The package of claim 7, wherein the second panel is adhesively attached to the first panel using a heat-seal coating.

11. The package of claim 7, wherein the sheet material is tear-resistant paperboard.

* * * * *